US009418643B2

(12) United States Patent
Eronen

(10) Patent No.: US 9,418,643 B2
(45) Date of Patent: Aug. 16, 2016

(54) AUDIO SIGNAL ANALYSIS

(75) Inventor: Antti Johannes Eronen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/409,647

(22) PCT Filed: Jun. 29, 2012

(86) PCT No.: PCT/IB2012/053329

§ 371 (c)(1),
(2), (4) Date: Sep. 13, 2015

(87) PCT Pub. No.: WO2014/001849

PCT Pub. Date: Jan. 3, 2014

(65) Prior Publication Data

US 2016/0005387 A1 Jan. 7, 2016

(51) Int. Cl.

| | |
|---|---|
| ***G10H 1/40*** | (2006.01) |
| ***G10H 7/00*** | (2006.01) |
| *G10L 25/51* | (2013.01) |

(52) U.S. Cl.

CPC ..... *G10H 1/40* (2013.01); *G10H 2210/051* (2013.01); *G10H 2210/066* (2013.01); *G10H 2210/076* (2013.01); *G10H 2220/081* (2013.01); *G10H 2220/086* (2013.01); *G10H 2230/015* (2013.01); *G10L 25/51* (2013.01)

(58) Field of Classification Search

CPC ..... G10H 1/00; G10H 1/40; G10H 2210/341; G10H 2210/061; G10H 2210/071; G10H 2210/076; G10H 2240/251; G10H 2250/135

See application file for complete search history.

(56) References Cited

U.S. PATENT DOCUMENTS

| | | | | |
|---|---|---|---|---|
| 6,542,869 | B1 * | 4/2003 | Foote | G06F 17/30743 704/200.1 |
| 7,612,275 | B2 * | 11/2009 | Seppanen | G10H 1/40 84/600 |
| 8,440,901 | B2 * | 5/2013 | Nakadai | G09B 15/02 84/612 |
| 2003/0205124 | A1 * | 11/2003 | Foote | G10G 1/00 84/608 |

(Continued)

FOREIGN PATENT DOCUMENTS

| | | | |
|---|---|---|---|
| JP | 2004-096617 | A | 3/2004 |
| JP | 2004-302053 | A | 10/2004 |

(Continued)

OTHER PUBLICATIONS

International Search Report and Written Opinion received for corresponding Patent Cooperation Treaty Application No. PCT/IB2012/053329, dated Apr. 15, 2013, 12 pages.

(Continued)

*Primary Examiner* — Jeffrey Donels
(74) *Attorney, Agent, or Firm* — Nokia Technologies Oy

(57) ABSTRACT

A server system 500 is provided for receiving video clips having an associated audio/musical track for processing at the server system. The system comprises a first beat tracking module for generating a first beat time sequence from the audio signal using an estimation of the signal's tempo and chroma accent information. A ceiling and floor function is applied to the tempo estimation to provide integer versions which are subsequently applied separately to a further accent signal derived from a lower-frequency sub-band of the audio signal to generate second and third beat time sequences. A selection module then compares each of the beat time sequences with the further accent signal to identify a best match.

20 Claims, 11 Drawing Sheets

(56) References Cited

U.S. PATENT DOCUMENTS

| | | | | |
|---|---|---|---|---|
| 2007/0261537 | A1* | 11/2007 | Eronen | G10H 1/40 84/611 |
| 2007/0291958 | A1* | 12/2007 | Jehan | G06N 99/005 381/103 |
| 2008/0236371 | A1* | 10/2008 | Eronen | G10H 1/0008 84/622 |
| 2010/0170382 | A1 | 7/2010 | Kobayashi | |
| 2010/0188580 | A1* | 7/2010 | Paschalakis | G06F 17/30802 348/571 |
| 2011/0255700 | A1* | 10/2011 | Maxwell | H04R 5/027 381/58 |
| 2014/0060287 | A1* | 3/2014 | Okuda | G10H 1/40 84/612 |
| 2015/0094835 | A1* | 4/2015 | Eronen | G06F 3/165 700/94 |

FOREIGN PATENT DOCUMENTS

| | | | |
|---|---|---|---|
| JP | 2006-518492 | A | 8/2006 |
| JP | 2007-052394 | A | 3/2007 |
| JP | 2008-076760 | A | 4/2008 |
| JP | 2008-233812 | A | 10/2008 |
| WO | 2004/042584 | A2 | 5/2004 |
| WO | 2013/164661 | A1 | 11/2013 |

OTHER PUBLICATIONS

McKinney, M.F. et al. "Evaluation of audio beat tracking and music tempo extraction logorithms", Journal on New Music research, vol. 36, No. 1, 2007, pp. 1-16.

Eronen A.J. et al. "Music tempo estimation with k-NN regression", IEEE trans. on Audio, Speech, and Language Processing, vol. 18, No. 1, Jan. 2010, pp. 50-57.

Seppanen J. et al. "Joint beat & tatum tracking from music signals", International conference on music information retrieval (ISMIR), Oct. 8-12, 2006, Victoria, Canada 6 pages.

Davies,M.E. P. et al. "Context-dependent beat tracking of muscial audio," IEEE Trans. on Audio, Speech, and Language Processing, vol. 15, No. 3, Mar. 2007, pp. 1009-1020.

Gkiokas A. et al. "Musci tempo estimation and beat tracking by applying source separation and metrical relations", IEEE International Conference on Acoustics, Speech, and Signal Processing (ICASSP), Mar. 25-30, 2012, Kyoto Japan pp. 42-424.

Ellis D.P.W. Beat tracking with dynamic programming:, MIREX 2006 Audio beat tracking Context system description, Sep. 2006, 3 pages.

Peeters et al., "Simultaneous Beat And Downbeat-Tracking Using a Probabilistic Framework: Theory And Large-Scale Evaluation", IEEE Transactions on Audio, Speech, and Language Processing, vol. 19, No. 6, Aug. 2011, pp. 1754-1759.

Klapuri et al., "Analysis Of The Meter Of Acoustic Musical Signals", IEEE Transactions on Audio, Speech, and Language Processing, vol. 14, No. 1, Jan. 2006, 15 Pages.

Jehan, "Creating Music by Listening", Thesis, Sep. 2005, pp. 1-137.

Ellis, "Beat Tracking by Dynamic Programming", Journal of New Music Research, vol. 36, No. 1, Mar. 2007, pp. 1-21.

Cemgil et al., "On Tempo Tracking: Tempogram Representation and Kalman filtering", Journal of New Music Research, vol. 29, No. 4, 2001, 19 pages.

International Search Report and Written Opinion received for corresponding Patent Cooperation Treaty Application No. PCT/IB2012/052157, dated Feb. 18, 2013, 12 pages.

Goto, "An Audio-Based Real-Time Beat Tracking System For Music With Or Without Drum-Sounds", Journal of New Music Research, vol. 30, No. 2, 2001, pp. 159-171.

Papadopoulos et al., "Joint Estimation Of Chords And Downbeats From An Audio Signal", IEEE Transactions on Audio, Speech, and Language Processing, vol. 19, No. 1, Jan. 2011, pp. 138-152.

Zenz et al., "Automatic Chord Detection Incorporating Beat and Key Detection", IEEE International Conference on Signal Processing and Communications, Nov. 24-27, 2007, pp. 1175-1178.

Degara et al., "Reliability-Informed Beat Tracking Of Musical Signals", IEEE Transactions on Audio, Speech, and Language Processing, vol. 20, No. 1, Jan. 2012, pp. 290-301.

Klapuri, "Multiple Fundamental Frequency Estimation By Summing Harmonic Amplitudes", Proceedings of the 7th International Conference on Music Information Retrieval, Oct. 8-12, 2006, 6 pages.

Extended European Search Report received for corresponding European Patent Application No. 12880120.6, dated Nov. 4, 2015, 12 pages.

Deinert et al., "Regression-Based Tempo Recognition From Chroma and Energy Accents For Slow Audio Recordings", Proceedings of the AES 42nd International Conference on Semantic Audio, Jul. 2011, 9 pages.

Extended European Search Report received for corresponding European Patent Application No. 12875874.5, dated Nov. 9, 2015, 08 pages.

Scaringella et al., "A Real-Time Beat Tracker for Unrestricted Audio Signals", In proceedings of the conference of sound and music computing, Oct. 20-22, 2004, 6 pages.

Papadopoulos et al., "Simultaneous Estimation Of Chord Progression And Downbeats From An Audio File", IEEE International Conference on Acoustics, Speech and Signal Processing, Mar. 31-Apr. 4, 2008, pp. 121-124.

Office action received for corresponding Japanese Patent Application No. 2015-519368, dated Feb. 4, 2016, 5 pages of office action and No English Language Translation available.

* cited by examiner

AUDIO SIGNAL ANALYSIS

RELATED APPLICATION

This application was originally filed as PCT Application No. PCT/IB2012/053329 filed Jun. 29, 2012.

FIELD OF THE INVENTION

This invention relates to audio signal analysis and particularly to music meter analysis.

BACKGROUND OF THE INVENTION

In music terminology, the music meter comprises the recurring pattern of stresses or accents in the music. The musical meter can be described as comprising a measure pulse, a beat pulse and a tatum pulse, respectively referring to the longest to shortest in terms of pulse duration.

Beat pulses provide the basic unit of time in music, and the rate of beat pulses (the tempo) is considered the rate at which most people would tap their foot on the floor when listening to a piece of music. Identifying the occurrence of beat pulses in a piece of music, or beat tracking as it is known, is desirable in a number of practical applications. Such applications include music recommendation applications in which music similar to a reference track is searched for, in Disk Jockey (DJ) applications where, for example, seamless beat-mixed transitions between songs in a playlist is required, and in automatic looping techniques.

Beat tracking systems and methods generate a beat sequence, comprising the temporal position of beats in a piece of music or part thereof.

The following terms are useful for understanding certain concepts to be described later.

Pitch: the physiological correlate of the fundamental frequency ($f_0$) of a note.

Chroma, also known as pitch class: musical pitches separated by an integer number of octaves belong to a common pitch class. In Western music, twelve pitch classes are used.

Beat or tactus: the basic unit of time in music, it can be considered the rate at which most people would tap their foot on the floor when listening to a piece of music. The word is also used to denote part of the music belonging to a single beat.

Tempo: the rate of the beat or tactus pulse, usually represented in units of beats per minute (BPM).

Bar or measure: a segment of time defined as a given number of beats of given duration. For example, in a music with a 4/4 time signature, each measure comprises four beats.

Accent or Accent-based audio analysis: analysis of an audio signal to detect events and/or changes in music, including but not limited to the beginning of all discrete sound events, especially the onset of long pitched sounds, sudden changes in loudness of timbre, and harmonic changes. Further detail is given below.

It is believed that humans perceive musical meter by inferring a regular pattern of pulses from accents, which are stressed moments in music. Different events in music cause accents. Examples include changes in loudness or timbre, harmonic changes, and in general the beginnings of all sound events. In particular, the onsets of long pitched sounds cause accents. Automatic tempo, beat, or downbeat estimators may try to imitate the human perception of music meter to some extent. This may involve the steps of measuring musical accentuation, performing period estimation of one or more pulses, finding the phases of the estimated pulses, and choosing the metrical level corresponding to the tempo or some other metrical level of interest. Since accents relate to events in music, accent based audio analysis refers to the detection of events and/or changes in music. Such changes may relate to changes in the loudness, spectrum and/or pitch content of the signal. As an example, accent based analysis may relate to detecting spectral change from the signal, calculating a novelty or an onset detection function from the signal, detecting discrete onsets from the signal, or detecting changes in pitch and/or harmonic content of the signal, for example, using chroma features. When performing the spectral change detection, various transforms or filter bank decompositions may be used, such as the Fast Fourier Transform or multi rate filter banks, or even fundamental frequency $f_0$ or pitch salience estimators. As a simple example, accent detection might be performed by calculating the short-time energy of the signal over a set of frequency bands in short frames over the signal, and then calculating the difference, such as the Euclidean distance, between every two adjacent frames. To increase the robustness for various music types, many different accent signal analysis methods have been developed.

The system and method to be described hereafter draws on background knowledge described in the following publications which are incorporated herein by reference.

[1] Cemgil A. T. et al., "On tempo tracking: tempogram representation and Kalman filtering." J. New Music Research, 2001.

[2] Eronen, A. and Klapuri, A., "Music Tempo Estimation with k-NN regression," IEEE Trans. Audio, Speech and Language Processing, Vol. 18, No. 1, January 2010.

[3] Seppänen, Eronen, Hiipakka. "Joint Beat & Tatum Tracking from Music Signals", International Conference on Music Information Retrieval, ISMIR 2006 and Jarno Seppanen, Antti Eronen, Jarmo Hiipakka: Method, apparatus and computer program product for providing rhythm information from an audio signal. Nokia November 2009: U.S. Pat. No. 7,612,275.

[4] Antti Eronen and Timo Kosonen, "Creating and sharing variations of a music file"—United States Patent Application 20070261537.

[5] Klapuri, A., Eronen, A., Astola, J., "Analysis of the meter of acoustic musical signals," IEEE Trans. Audio, Speech, and Language Processing, Vol. 14, No. 1, 2006.

[6] Jehan, Creating Music by Listening, PhD Thesis, MIT, 2005. http://web.media.mit.edu/~tristan/phd/pdf/Tristan_PhD_MIT.pdf

[7] D. Ellis, "Beat Tracking by Dynamic Programming", J. New Music Research, Special Issue on Beat and Tempo Extraction, vol. 36 no. 1, March 2007, pp. 51-60. (10pp) DOI: 10.1080/09298210701653344.

[8] A. Klapuri, "Multiple fundamental frequency estimation by summing harmonic amplitudes," in Proc. 7th Int. Conf. Music Inf. Retrieval (ISMIR-06), Victoria, Canada, 2006.

SUMMARY OF THE INVENTION

A first aspect of the invention provides apparatus comprising:

- a first accent signal module for generating a first accent signal ($a_1$) representing musical accents in an audio signal;
- a second accent signal module for generating a second, different, accent signal ($a_2$) representing musical accents in the audio signal;
- a first beat tracking module for estimating a first beat time sequence ($b_1$) from the first accent signal;

a second beat tracking module for estimating a second beat time sequence ($b_2$) from the second accent signal; and a sequence selector for identifying which one of the first and second beat time sequences ($b_1$) ($b_2$) corresponds most closely with peaks in one or both of the accent signal(s).

The apparatus provides a robust and computationally straightforward system and method for identifying the position of beats in a music signal. In particular, the apparatus provides a robust and accurate way of beat tracking over a range of musical styles, ranging from electronic music to classical and rock music. Electronic dance music in particular is processed more accurately.

The first accent signal module may be configured to generate the first accent signal ($a_1$) by means of extracting chroma accent features based on fundamental frequency ($f_0$) salience analysis.

The apparatus may further comprise a tempo estimator configured to generate using the first accent signal ($a_1$) the estimated tempo ($BPM_{est}$) of the audio signal.

The first beat tracking module may be configured to estimate the first beat time sequence using the first accent signal ($a_1$) and the estimated tempo ($BPM_{est}$).

The second accent signal module may configured to generate the second accent signal ($a_2$) using a predetermined sub-band of the audio signal's bandwidth. The predetermined sub-band may be below 200 Hz.

The second accent signal module may be configured to generate the second accent signal ($a_2$) by means of performing a multi-rate filter bank decomposition of the audio signal and generating the accent signal using the output from a predetermined one of the filters.

The apparatus may further comprise means for obtaining an integer representation of the estimated tempo ($BPM_{est}$) and wherein the second beat tracking module may be configured to generate the second beat time sequence ($b_2$) using the second accent signal ($a_2$) and the integer representation.

The integer representation of the estimated tempo ($BPM_{est}$) may be calculated using either a rounded tempo estimate function (round($BPM_{est}$)), a ceiling tempo estimate function (ceil($BPM_{est}$)) or a floor tempo estimate function (floor($BPM_{est}$)).

The apparatus may further comprise means for performing a ceiling and floor function on the estimated tempo ($BPM_{est}$) to generate respectively a ceiling tempo estimate (ceil($BPM_{est}$) and a floor tempo estimate (floor($BPM_{est}$)), wherein the second beat tracking module may be configured to generate the second and a third beat time sequence ($b_2$) ($b_3$) using the second accent signal ($a_2$) and different ones of the ceiling and floor tempo estimates, and wherein the sequence selector may be configured to identify which one of the first, second and third beat time sequences corresponds most closely with peaks in one or both of the accent signal(s).

The second beat tracking module may be configured, for each of the ceiling and floor tempo estimates, to generate an initial beat time sequence ($b_t$) using said estimate, to compare it with a reference beat time sequence ($b_i$) and to generate using a predetermined similarity algorithm the second and third beat time sequences.

The predetermined similarity algorithm used by the second beat tracking module may comprise comparing the initial beat time sequence ($b_t$) and the reference beat time sequence ($b_i$) over a range of offset positions to identify a best match within the range, the generated second/third beat time sequence comprising the offset version of the reference beat time sequence ($b_i$) which resulted in the best match.

The reference beat time sequence ($b_i$) may have a constant beat interval. The reference beat time sequence ($b_i$) may be generated as t=0, 1/(X/60), 2/(X/60) . . . n/(Xt/60) where X is the integer estimate representation of the estimated tempo and n is an integer.

The range of offset positions used in the algorithm may be between 0 and 1.1/(X/60) where X is the integer estimate representation of the estimated tempo. The offset positions used for comparison in the algorithm may have steps of $0.1/(BPM_{est}/60)$.

The sequence selector may be configured to identify which one of the beat time sequences corresponds most closely with peaks in the second accent signal.

The sequence selector may be configured, for each of the beat time sequences, to calculate a summary statistic or value that is dependent on the values of the or each accent signal occurring at or around beat times in the sequence, and to select the beat time sequence which results in the greatest summary statistic or value.

The sequence selector may be configured, for each of the beat time sequences, to calculate the average or mean value of the or each accent signal occurring at or around beat times in the sequence, and to select the beat time sequence which results in the greatest mean value.

Further, there may be provided an apparatus according to any of the above definitions, comprising: means for receiving a plurality of video clips, each having a respective audio signal having common content; and a video editing module for identifying possible editing points for the video clips using the beats in the selected beat sequence. The video editing module may be further configured to join a plurality of video clips at one or more editing points to generate a joined video clip.

A second aspect of the invention provides a method comprising: generating a first accent signal ($a_1$) representing musical accents in an audio signal; generating a second, different, accent signal ($a_2$) representing musical accents in the audio signal; estimating a first beat time sequence ($b_1$) from the first accent signal; estimating a second beat time sequence ($b_2$) from the second accent signal; and identifying which one of the first and second beat time sequences ($b_1$) ($b_2$) corresponds most closely with peaks in one or both of the accent signal(s).

The first accent signal ($a_1$) may be generated by means of extracting chroma accent features based on fundamental frequency ($f_0$) salience analysis.

The method may further comprise generating using the first accent signal ($a_1$) the estimated tempo ($BPM_{est}$) of the audio signal.

The first beat time sequence may be generated using the first accent signal ($a_1$) and the estimated tempo ($BPM_{est}$).

The second accent signal ($a_2$) may be generated using a predetermined sub-band of the audio signal's bandwidth.

The second accent signal ($a_2$) may be generated using a predetermined sub-band below 200 Hz.

The second accent signal ($a_2$) may be generated by means of performing a multi-rate filter bank decomposition of the audio signal and using the output from a predetermined one of the filters.

The method may further comprise obtaining an integer representation of the estimated tempo ($BPM_{est}$) and generating the second beat time sequence ($b_2$) using the second accent signal ($a_2$) and said integer representation.

The integer representation of the estimated tempo ($BPM_{est}$) may be calculated using either a rounded tempo estimate function (round($BPM_{est}$)), a ceiling tempo estimate function (ceil($BPM_{est}$)) or a floor tempo estimate function (floor($BPM_{est}$)).

The method may further comprise performing a ceiling and floor function on the estimated tempo ($BPM_{est}$) to generate respectively a ceiling tempo estimate (ceil($BPM_{est}$) and a floor tempo estimate (floor($BPM_{est}$)), generating the second and a third beat time sequence ($b_2$) ($b_3$) using the second accent signal ($a_2$) and different ones of the ceiling and floor tempo estimates, and identifying which one of the first, second and third beat time sequences corresponds most closely with peaks in one or both of the accent signal(s). For each of the ceiling and floor tempo estimates, an initial beat time sequence ($b_t$) may be generated using said estimate, said initial beat time sequence then being compared with a reference beat time sequence ($b_i$) for generating the second and third beat time sequences using a predetermined similarity algorithm.

The comparison step using the predetermined similarity algorithm may comprise comparing the initial beat time sequence ($b_t$) and the reference beat time sequence ($b_i$) over a range of offset positions to identify a best match within the range, the generated second/third beat time sequence comprising the offset version of the reference beat time sequence ($b_i$) which resulted in the best match.

The reference beat time sequence ($b_i$) may have a constant beat interval.

The reference beat time sequence ($b_i$) may be generated as t=0, 1/(X/60), 2/(X/60) . . . n/(X/60) where X is the integer estimate representation of the estimated tempo and n is an integer.

The range of offset positions used in the algorithm may be between 0 and 1.1/(X/60) where X is the integer estimate representation of the estimated tempo. The offset positions used for comparison in the algorithm may have steps of 0.1/($BPM_{est}$/60).

The identifying step may comprise identifying which one of the beat time sequences corresponds most closely with peaks in the second accent signal.

The identifying step may comprise calculating, for each of the beat time sequences, a summary statistic or value that is dependent on the values of the or each accent signal occurring at or around beat times in the sequence, and selecting the beat time sequence which results in the greatest summary statistic or value.

The identifying step may comprise calculating, for each of the beat time sequences, the average or mean value of the or each accent signal occurring at or around beat times in the sequence, and selecting the beat time sequence which results in the greatest mean value.

There may also be provided a method which uses the beat identifying method defined above, the method comprising: receiving a plurality of video clips, each having a respective audio signal having common content; and identifying possible editing points for the video clips using the beats in the selected beat sequence. This method may further comprise joining a plurality of video clips at one or more editing points to generate a joined video clip.

A third aspect of the invention provides a computer program comprising instructions that when executed by a computer apparatus control it to perform the method according to any of the above definitions.

A fourth aspect of the invention provides a non-transitory computer-readable storage medium having stored thereon computer-readable code, which, when executed by computing apparatus, causes the computing apparatus to perform a method comprising: generating a first accent signal ($a_1$) representing musical accents in an audio signal; generating a second, different, accent signal ($a_2$) representing musical accents in the audio signal; estimating a first beat time sequence ($b_1$) from the first accent signal; estimating a second beat time sequence ($b_2$) from the second accent signal; and identifying which one of the first and second beat time sequences ($b_1$) ($b_2$) corresponds most closely with peaks in one or both of the accent signal(s).

A fifth aspect of the invention provides an apparatus, the apparatus having at least one processor and at least one memory having computer-readable code stored thereon which when executed controls the at least one processor: to generate a first accent signal ($a_1$) representing musical accents in an audio signal; to generate a second, different, accent signal ($a_2$) representing musical accents in the audio signal; to estimate a first beat time sequence ($b_1$) from the first accent signal; to estimate a second beat time sequence ($b_2$) from the second accent signal; and to identify which one of the first and second beat time sequences ($b_1$) ($b_2$) corresponds most closely with peaks in one or both of the accent signal(s).

The computer-readable code when executed may control the at least one processor to generate the first accent signal ($a_1$) by means of extracting chroma accent features based on fundamental frequency ($f_0$) salience analysis.

The computer-readable code when executed may control the at least one processor to 3*o* generate using the first accent signal ($a_1$) the estimated tempo ($BPM_{est}$) of the audio signal.

The computer-readable code when executed may control the at least one processor to generate the first beat time sequence using the first accent signal ($a_1$) and the estimated tempo ($BPM_{est}$).

The computer-readable code when executed may control the at least one processor to generate the second accent signal ($a_2$) using a predetermined sub-band of the audio signal's bandwidth.

The computer-readable code when executed may control the at least one processor to generate the second accent signal ($a_2$) using a predetermined sub-band below 200 Hz.

The computer-readable code when executed may control the at least one processor to generate the second accent signal ($a_2$) by means of performing a multi-rate filter bank decomposition of the audio signal and using the output from a predetermined one of the filters.

The computer-readable code when executed may control the at least one processor to obtain an integer representation of the estimated tempo ($BPM_{est}$) and generate the second beat time sequence ($b_2$) using the second accent signal ($a_2$) and said integer representation.

The computer-readable code when executed may control the at least one processor to calculate the integer representation of the estimated tempo ($BPM_{est}$) using either a rounded tempo estimate function (round($BPM_{est}$)), a ceiling tempo estimate function (ceil($BPM_{est}$)) or a floor tempo estimate function (floor($BPM_{est}$)).

The computer-readable code when executed may control the at least one processor to perform a ceiling and floor function on the estimated tempo ($BPM_{est}$) to generate respectively a ceiling tempo estimate (ceil($BPM_{est}$) and a floor tempo estimate (floor($BPM_{est}$)), to generate the second and a third beat time sequence ($b_2$) ($b_3$) using the second accent signal ($a_2$) and different ones of the ceiling and floor tempo estimates, and to identify which one of the first, second and third beat time sequences corresponds most closely with peaks in one or both of the accent signal(s).

The computer-readable code when executed may control the at least one processor to generate, for each of the ceiling and floor tempo estimates, an initial beat time sequence ($b_t$)

using said estimate, said initial beat time sequence then being compared with a reference beat time sequence ($b_i$) for generating the second and third beat time sequences using a predetermined similarity algorithm.

The computer-readable code when executed may control the at least one processor to compare the initial beat time sequence ($b_i$) and the reference beat time sequence ($b_i$) over a range of offset positions to identify a best match within the range, the generated second/third beat time sequence comprising the offset version of the reference beat time sequence ($b_i$) which resulted in the best match.

The reference beat time sequence ($b_i$) may have a constant beat interval.

The computer-readable code when executed may control the at least one processor to generate the reference beat time sequence ($b_i$) as t=0, 1/(X/60), 2/(X/60) . . . n/(X/60) where X is the integer representation of the estimated tempo and n is an integer.

The computer-readable code when executed may control the at least one processor to use a range of offset positions in the algorithm between 0 and 1.1/(X/60) where X is the integer representation of the estimated tempo.

The computer-readable code when executed may control the at least one processor to use offset positions for comparison in the algorithm having steps of $0.1/(BPM_{est}/60)$.

The computer-readable code when executed may control the at least one processor to identify which one of the beat time sequences corresponds most closely with peaks in the second accent signal.

The computer-readable code when executed may control the at least one processor to calculate, for each of the beat time sequences, a summary statistic or value that is dependent on the values of the or each accent signal occurring at or around beat times in the sequence, and to select the beat time sequence which results in the greatest summary statistic or value.

The computer-readable code when executed may control the at least one processor to calculate, for each of the beat time sequences, the average or mean value of the or each accent signal occurring at or around beat times in the sequence, and to select the beat time sequence which results in the greatest mean value.

The computer-readable code when executed may controls the at least one processor to: receive a plurality of video clips, each having a respective audio signal having common content; and identify possible editing points for the video clips using the beats in the selected beat sequence.

The computer-readable code when executed may control the at least one processor to join a plurality of video clips at one or more editing points to generate a joined video clip.

BRIEF DESCRIPTION OF THE DRAWINGS

Embodiments of the invention will now be described by way of non-limiting example with reference to the accompanying drawings, in which.

DETAILED DESCRIPTION OF EMBODIMENTS

Embodiments described below relate to systems and methods for audio analysis, primarily the analysis of music and its musical meter in order to identify the temporal location of beats in a piece of music or part thereof. The process is commonly known as beat tracking. As noted above, beats are considered to represent musically meaningful points that can be used for various practical applications, including music recommendation algorithms, DJ applications and automatic looping. The specific embodiments described below relate to a video editing system which automatically cuts video clips using the location of beats identified in their associated audio track as potential video angle switching points.

Figure 1:
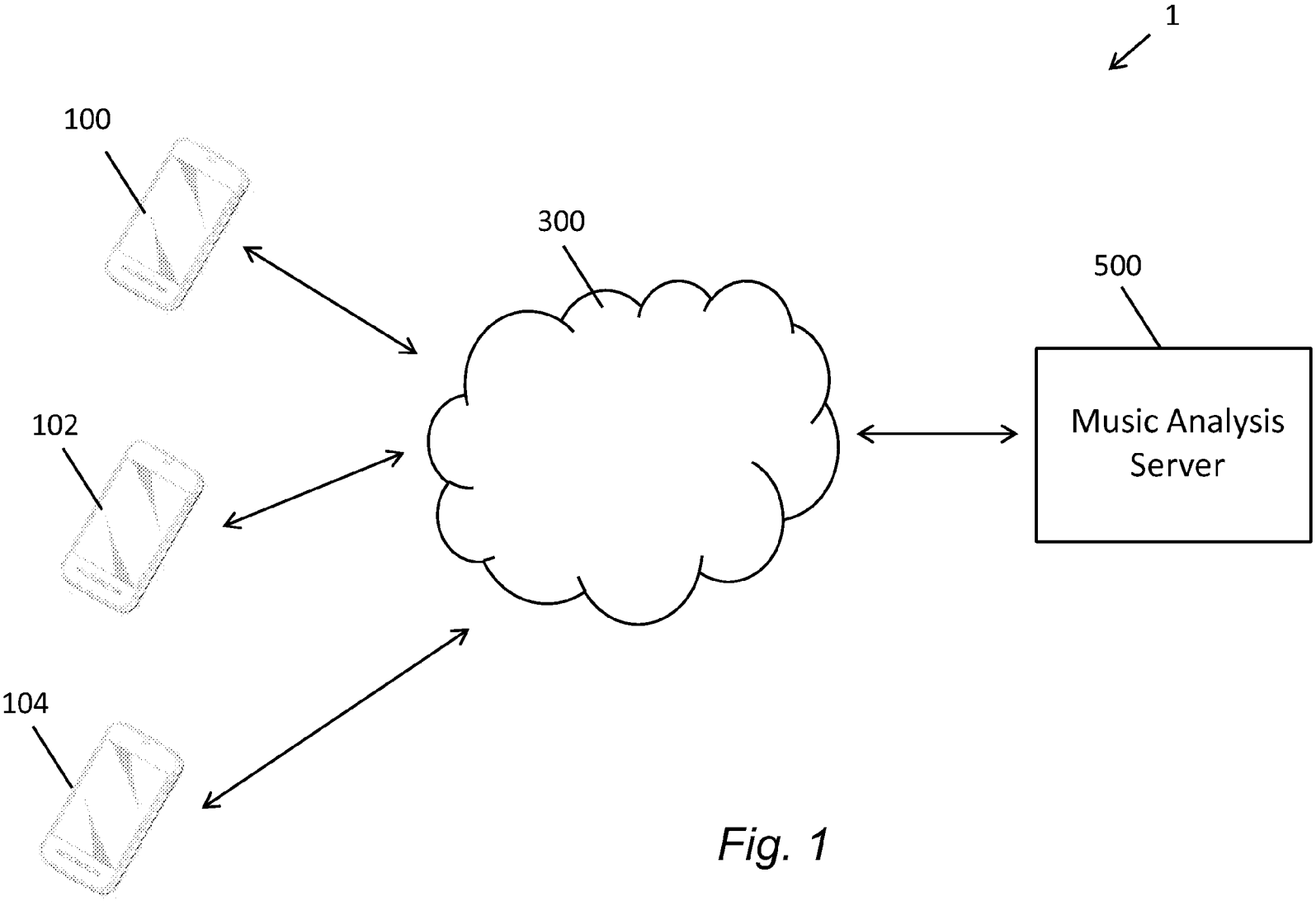
FIG. 1 is a schematic diagram of a network including a music analysis server according to embodiments of the invention and a plurality of terminals.

Referring to FIG. 1, a music analysis server 500 (hereafter "analysis server") is shown connected to a network 300, which can be any data network such as a Local Area Network (LAN), Wide Area Network (WAN) or the Internet. The analysis server 500 is configured to analyse audio associated with received video clips in order to perform beat tracking for the purpose of automated video editing. This will be described in detail later on.

External terminals 100, 102, 104 in use communicate with the analysis server 500 via the network 300, in order to upload video clips having an associated audio track. In the present case, the terminals 100, 102, 104 incorporate video camera and audio capture (i.e. microphone) hardware and software for the capturing, storing, uploading and downloading of video data over the network 300.

Figure 2:
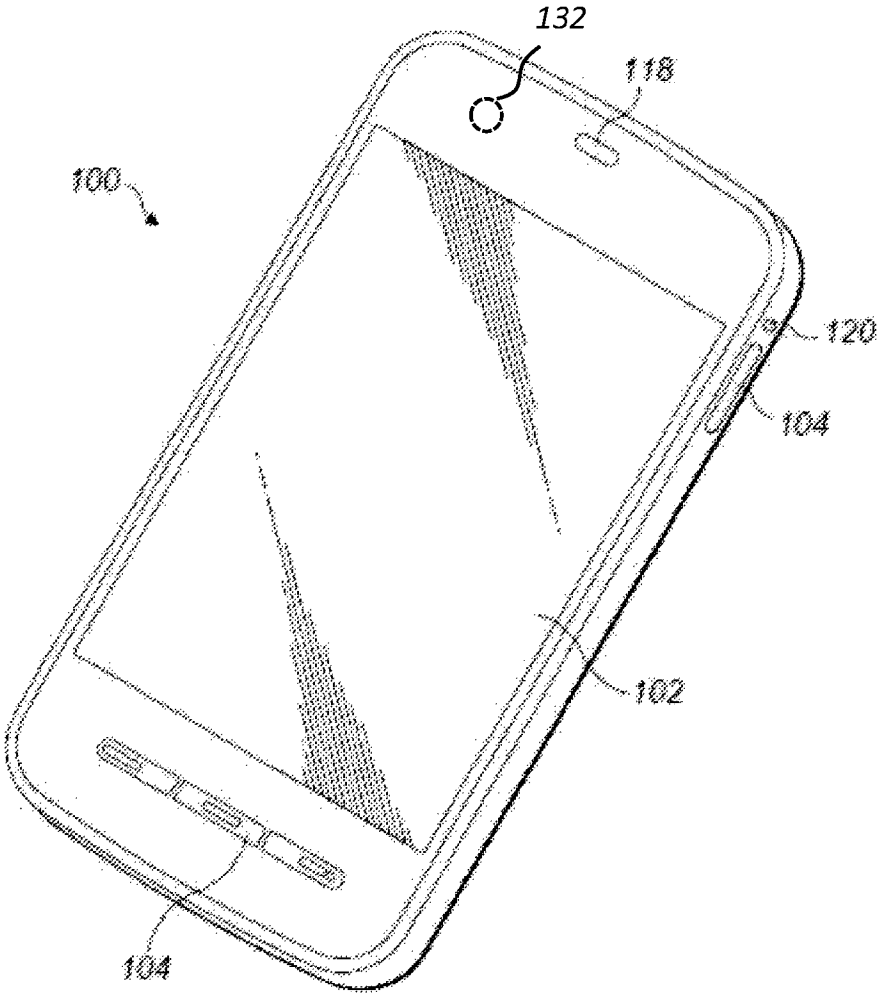
FIG. 2 is a perspective view of one of the terminals shown in FIG. 1.

Referring to FIG. 2, one of said terminals 100 is shown, although the other terminals 102, 104 are considered identical or similar. The exterior of the terminal 100 has a touch sensitive display 102, hardware keys 104, a rear-facing camera 105, a speaker 118 and a headphone port 120.

Figure 3:
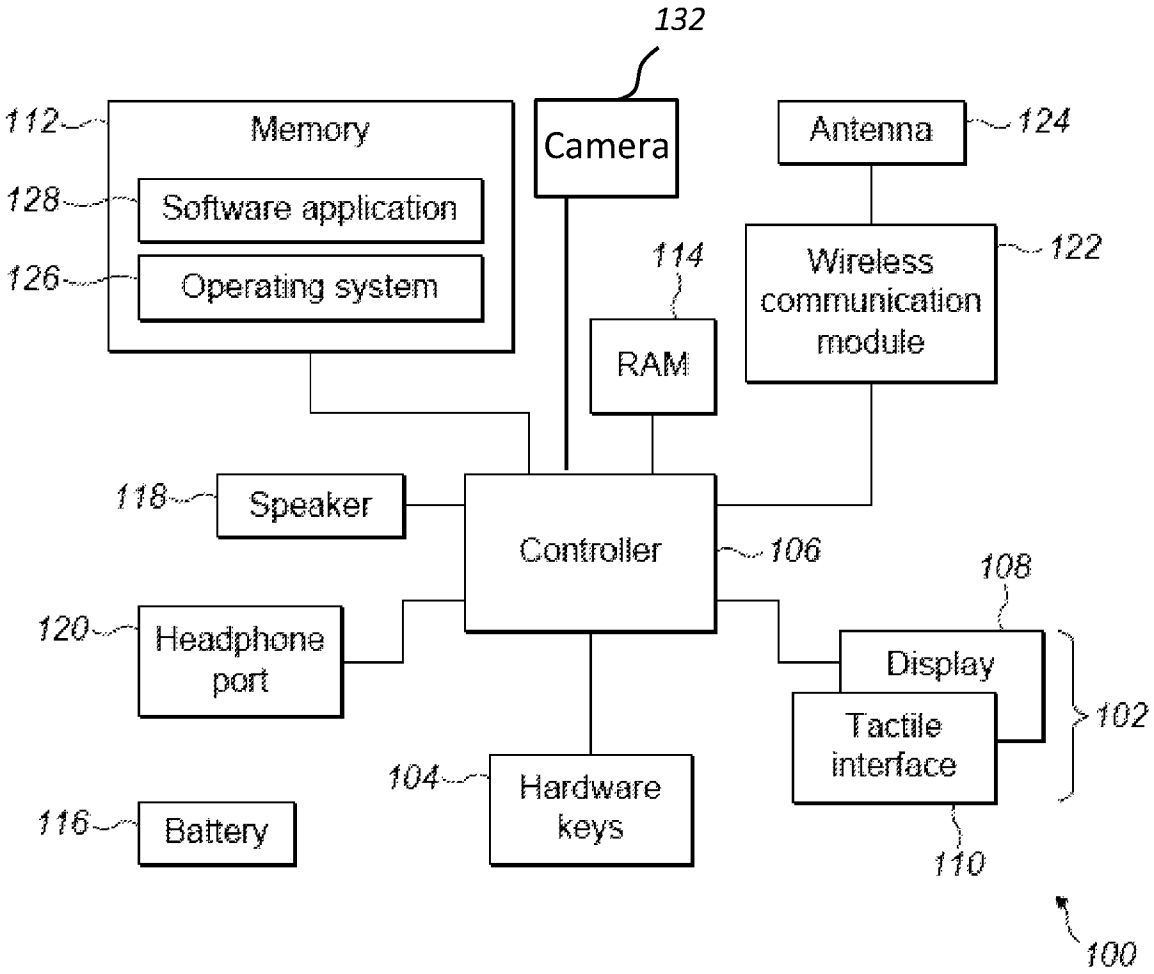
FIG. 3 is a schematic diagram of components of the terminal shown in FIG. 2.

FIG. 3 shows a schematic diagram of the components of terminal 100. The terminal 100 has a controller 106, a touch sensitive display 102 comprised of a display part 108 and a tactile interface part 110, the hardware keys 104, the camera 132, a memory 112, RAM 114, a speaker 118, the headphone port 120, a wireless communication module 122, an antenna 124 and a battery 116. The controller 106 is connected to each of the other components (except the battery 116) in order to control operation thereof.

The memory 112 may be a non-volatile memory such as read only memory (ROM) a hard disk drive (HDD) or a solid state drive (SSD). The memory 112 stores, amongst other things, an operating system 126 and may store software applications 128. The RAM 114 is used by the controller 106 for the temporary storage of data. The operating system 126 may contain code which, when executed by the controller 106 in conjunction with RAM 114, controls operation of each of the hardware components of the terminal.

The controller 106 may take any suitable form. For instance, it may be a microcontroller, plural microcontrollers, a processor, or plural processors.

The terminal 100 may be a mobile telephone or smartphone, a personal digital assistant (PDA), a portable media player (PMP), a portable computer or any other device capable of running software applications and providing audio outputs. In some embodiments, the terminal 100 may engage in cellular communications using the wireless communications module 122 and the antenna 124. The wireless communications module 122 may be configured to communicate via several protocols such as Global System for Mobile Communications (GSM), Code Division Multiple Access (CDMA), Universal Mobile Telecommunications System (UMTS), Bluetooth and IEEE 802.11 (Wi-Fi).

The display part 108 of the touch sensitive display 102 is for displaying images and text to users of the terminal and the tactile interface part 110 is for receiving touch inputs from users.

As well as storing the operating system 126 and software applications 128, the memory 112 may also store multimedia files such as music and video files. A wide variety of software applications 128 may be installed on the terminal including Web browsers, radio and music players, games and utility applications. Some or all of the software applications stored on the terminal may provide audio outputs. The audio provided by the applications may be converted into sound by the speaker(s) 118 of the terminal or, if headphones or speakers have been connected to the headphone port 120, by the headphones or speakers connected to the headphone port 120.

In some embodiments the terminal 100 may also be associated with external software application not stored on the terminal. These may be applications stored on a remote server device and may run partly or exclusively on the remote server device. These applications can be termed cloud-hosted applications. The terminal 100 may be in communication with the remote server device in order to utilise the software application stored there. This may include receiving audio outputs provided by the external software application.

In some embodiments, the hardware keys 104 are dedicated volume control keys or switches. The hardware keys may for example comprise two adjacent keys, a single rocker switch or a rotary dial. In some embodiments, the hardware keys 104 are located on the side of the terminal 100.

One of said software applications 128 stored on memory 112 is a dedicated application (or "App") configured to upload captured video clips, including their associated audio track, to the analysis server 500.

The analysis server 500 is configured to receive video clips from the terminals 100, 102, 104 and to perform beat tracking of each associated audio track for the purposes of automatic video processing and editing, for example to join clips together at musically meaningful points. Instead of performing beat tracking of each associated audio track, the analysis server 500 may be configured to perform beat tracking in a common audio track which has been obtained by combining parts from the audio track of one or more video clips.

Figure 4:
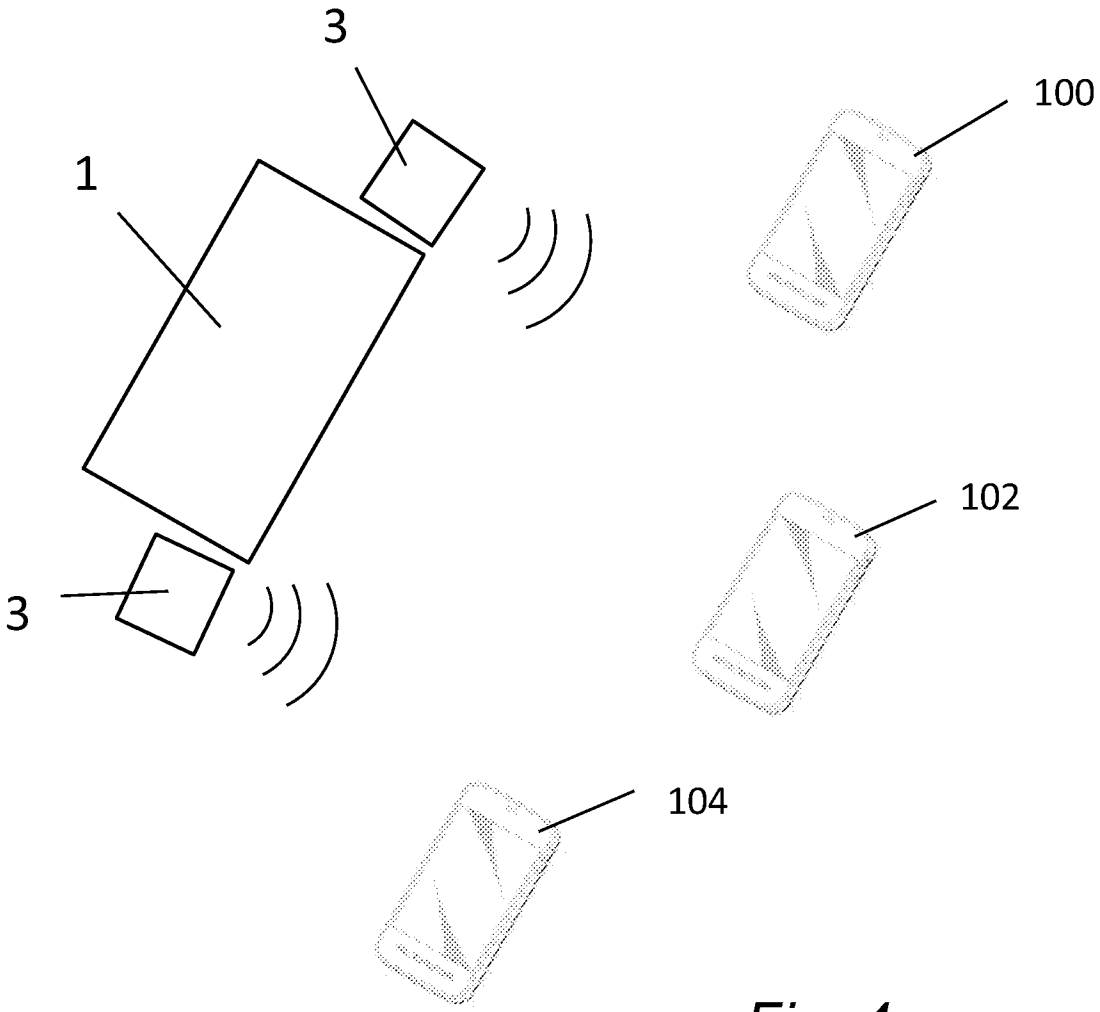
FIG. 4 is a schematic diagram showing the terminals of FIG. 1 when used at a common musical event.

Referring to FIG. 4, a practical example will now be described. Each of the terminals 100, 102, 104 is shown in use at an event which is a music concert represented by a stage area 1 and speakers 3. Each terminal 100, 102, 104 is assumed to be capturing the event using their respective video cameras; given the different positions of the terminals 100, 102, 104 the respective video clips will be different but there will be a common audio track providing they are all capturing over a common time period.

Users of the terminals 100, 102, 104 subsequently upload their video clips to the analysis server 500, either using their above-mentioned App or from a computer with which the terminal synchronises. At the same time, users are prompted to identify the event, either by entering a description of the event, or by selecting an already-registered event from a pull-down menu. Alternative identification methods may be envisaged, for example by using associated GPS data from the terminals 100, 102, 104 to identify the capture location.

At the analysis server 500, received video clips from the terminals 100, 102, 104 are identified as being associated with a common event. Subsequent analysis of each video clip can then be performed to identify beats which are used as useful video angle switching points for automated video editing.

Figure 5:
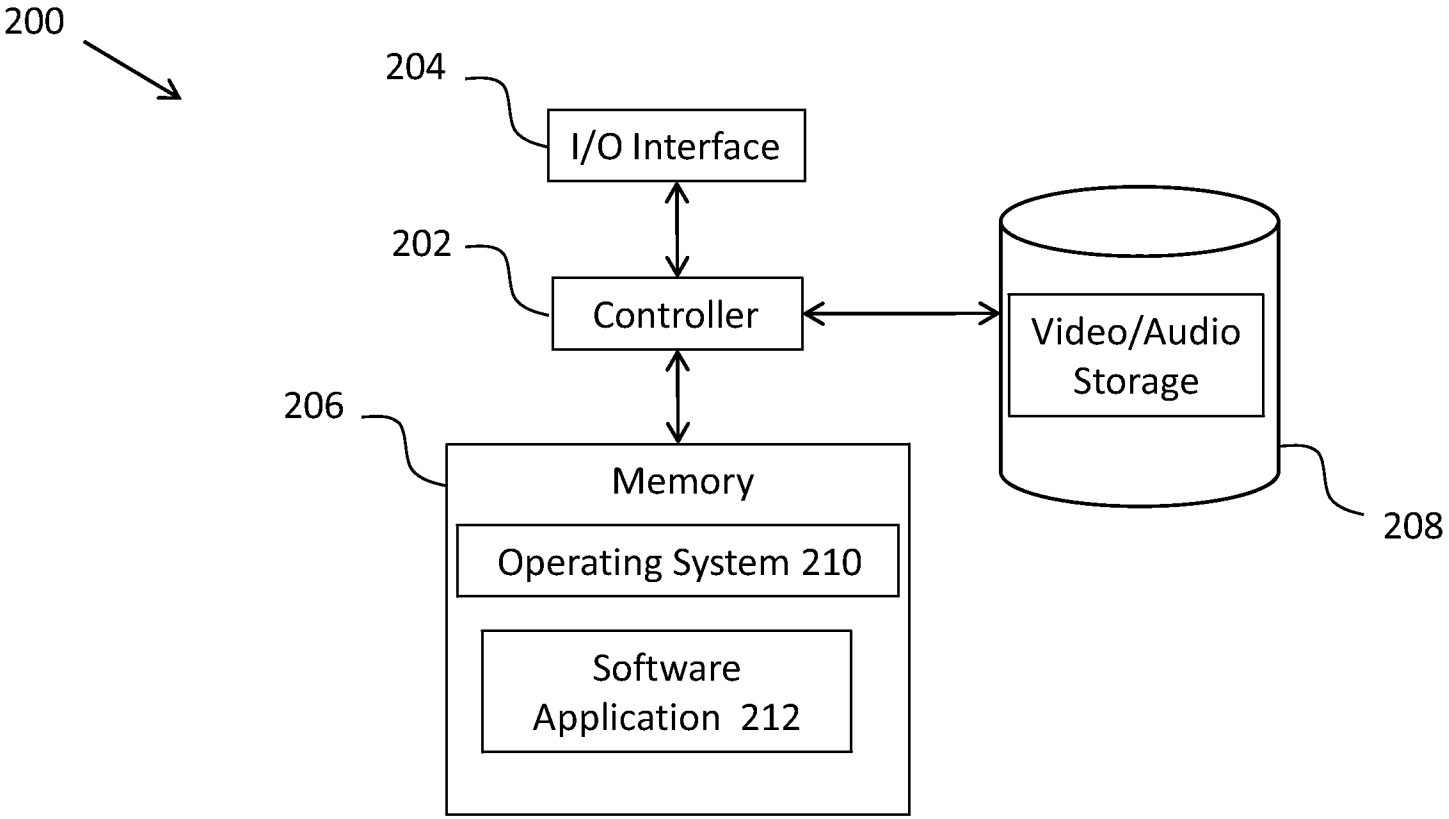
FIG. 5 is a schematic diagram of components of the analysis server shown in FIG. 1.

Referring to FIG. 5, hardware components of the analysis server 500 are shown. These include a controller 202, an input and output interface 204, a memory 206 and a mass storage device 208 for storing received video and audio clips. The controller 202 is connected to each of the other components in order to control operation thereof.

The memory 206 (and mass storage device 208) may be a non-volatile memory such as read only memory (ROM) a hard disk drive (HDD) or a solid state drive (SSD). The memory 206 stores, amongst other things, an operating system 210 and may store software applications 212. RAM (not shown) is used by the controller 202 for the temporary storage of data. The operating system 210 may contain code which, when executed by the controller 202 in conjunction with RAM, controls operation of each of the hardware components.

The controller 202 may take any suitable form. For instance, it may be a microcontroller, plural microcontrollers, a processor, or plural processors.

The software application 212 is configured to control and perform the video processing; including processing the associated audio signal to perform beat tracking. This can alternatively be performed using a hardware-level implementation as opposed to software or a combination of both hardware and software.

The beat tracking process is described with reference to FIG. 6.

It will be seen that there are, conceptually at least, two processing paths, starting from steps 6.1 and 6.6. The reference numerals applied to each processing stage are not indicative of order of processing. In some implementations, the processing paths might be performed in parallel allowing fast execution. In overview, three beat time sequences are generated from an inputted audio signal, specifically from accent signals derived from the audio signal. A selection stage then identifies which of the three beat time sequences is a best match or fit to one of the accent signals, this sequence being considered the most useful and accurate for the video processing application or indeed any application with which beat tracking may be useful.

Each processing stage will now be considered in turn.

First (Chroma) Accent Signal Stage

The method starts in steps 6.1 and 6.2 by calculating a first accent signal ($a_1$) based on fundamental frequency ($F_o$) salience estimation. This accent signal ($a_1$), which is a chroma accent signal, is extracted as described in [2]. The chroma accent signal ($a_1$) represents musical change as a function of time and, because it is extracted based on the $F_o$ information, it emphasizes harmonic and pitch information in the signal.

Note that, instead of calculating an chroma accent signal based on $F_o$ salience estimation, alternative accent signal representations and calculation methods could be used. For example, the accent signals described in [5] or [7] could be utilized.

Figure 9:
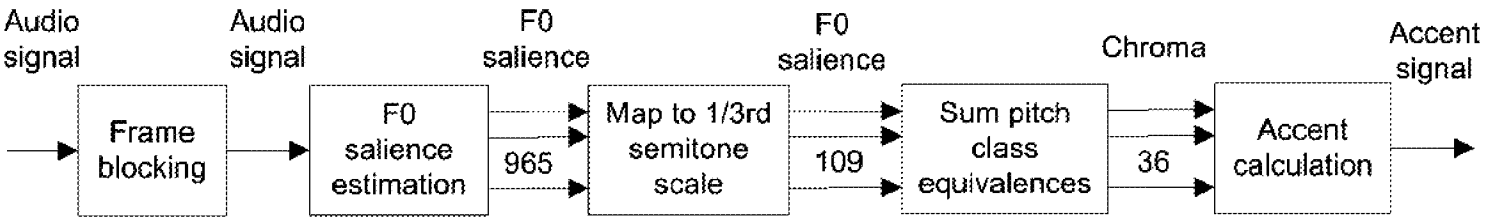
FIG. 9 depicts an overview of the first accent signal calculation method.

FIG. 9 depicts an overview of the first accent signal calculation method. The first accent signal calculation method uses chroma features. There are various ways to extract chroma features, including, for example, a straightforward summing of Fast Fourier Transform bin magnitudes to their corresponding pitch classes or using a constant-Q transform. In our method, we use a multiple fundamental frequency ($F_o$) estimator to calculate the chroma features. The $F_o$ estimation can be done, for example, as proposed in [8]. The input to the method may be sampled at a 44.1-kHz sampling rate and have a 16-bit resolution. Framing may be applied on the input signal by dividing it into frames with a certain amount of overlap. In our implementation, we have used 93-ms frames having 50% overlap. The method first spectrally whitens the signal frame, and then estimates the strength or salience of each $F_o$ candidate. The $F_o$ candidate strength is calculated as a weighted sum of the amplitudes of its harmonic partials. The range of fundamental frequencies used for the estimation is 80-640 Hz. The output of the $F_o$ estimation step is, for each frame, a vector of strengths of fundamental frequency candidates. Here, the fundamental frequencies are represented on a linear frequency scale. To better suit music signal analysis, the fundamental frequency saliences are transformed on a musical frequency scale. In particular, we use a frequency scale having a resolution of $\frac{1}{3}^{rd}$-semitones, which corresponds to having 36 bins per octave. For each ⅓rd of a semitone range, the system finds the fundamental frequency component with the maximum salience value and retains only that. To obtain a 36-dimensional chroma vector $x_b(k)$, where k is the frame index and b=1, 2, . . . , $b_o$ is the pitch class index, with $b_o$=36, the octave equivalence classes are summed over the whole pitch range. A normalized matrix of chroma vectors $\hat{x}_b(k)$ is obtained by subtracting the mean and dividing by the standard deviation of each chroma coefficient over the frames k.

The following step is estimation of musical accent using the normalized chroma matrix $\hat{x}_b(k)$, k=1, . . . , K and b=1, 2, . . . , $b_o$. The accent estimation resembles the method proposed in [5], but instead of frequency bands we use pitch classes here. To improve the time resolution, the time trajectories of chroma coefficients may be first interpolated by an integer factor. We have used interpolation by the factor eight. A straightforward method of interpolation by adding zeros between samples may be used. With our parameters, after the interpolation, the resulting sampling rate $f_r$=172 Hz. This is followed by a smoothing step, which is done by applying a sixth-order Butterworth low-pass filter (LPF). The LPF has a cuttoff frequency of $f_{LP}$=10 Hz. We denote the signal after smoothing with $z_b$ (n). The following step comprises differential calculation and half-wave rectification (HWR):

$$\dot{z}_b(n)=HWR(z_b(n)-z_b(n-1)) \tag{1}$$

with HWR(x)=max(x, 0). In the next step, a weighted average of $z_b(n)$ and its half-wave rectified differential $\dot{z}_b(n)$ is formed. The resulting signal is $$u_b(n) = (1-\rho)z_b(n) + \rho\frac{f_r}{f_{LP}}\dot{z}_b(n). \tag{2}$$

In Equation (2), the factor 0≤p≤1 controls the balance between $z_b(n)$ and its half-wave rectified differential. In our implementation, the value of ρ=0.6. In one embodiment of the invention, we obtain an accent signal $a_1$ based on the above accent signal analysis by linearly averaging the bands b. Such an accent signal represents the amount of musical emphasis or accentuation over time.

First Beat Tracking Stage

In step 6.3, an estimation of the audio signal's tempo (hereafter "$BPM_{est}$") is made using the method described in [2].

The first step in the tempo estimation is periodicity analysis. The periodicity analysis is performed on the accent signal ($a_1$). The generalized autocorrelation function (GACF) is used for periodicity estimation. To obtain periodicity estimates at different temporal locations of the signal, the GACF is calculated in successive frames. The length of the frames is W and there is 16% overlap between adjacent frames. No windowing is used. At the mth frame, the input vector for the GACF is denoted $a_m$:

$$a_m=[a_1((m-1)W), \ldots ,a_1(mW-1),0, \ldots ,0]^T \tag{3}$$

where T denotes transpose. The input vector is zero padded to twice its length, thus, its length is 2W. The GACF may be defined as $$\gamma_m(\tau)=IDFT(|DFT(a_m)|^p) \tag{4}$$

where discrete Fourier transform and its inverse are denoted by DFT and IDFT, respectively. The amount of frequency domain compression is controlled using the coefficient p. The strength of periodicity at period (lag) τ is given by $\gamma_m(\tau)$.

Other alternative periodicity estimators to the GACF include, for example, inter onset interval histogramming, autocorrelation function (ACF), or comb filter banks. Note that the conventional ACF can be obtained by setting p=2 in Equation (4). The parameter p may need to be optimized for different accent features. This may be done, for example, by experimenting with different values of p and evaluating the accuracy of periodicity estimation. The accuracy evaluation can be done, for example, by evaluating the tempo estimation accuracy on a subset of tempo annotated data. The value which leads to best accuracy may be selected to be used. For the chroma accent features used here, we can use, for example, the value p=0.65, which was found to perform well in this kind of experiments for the used accent features.

After periodicity estimation, there exists a sequence of periodicity vectors from adjacent frames. To obtain a single representative tempo for a musical piece or a segment of music, a point-wise median of the periodicity vectors over time may be calculated. The median periodicity vector may be denoted by $\gamma_{med}(\tau)$. Furthermore, the median periodicity vector may be normalized to remove a trend $$\hat{\gamma}_{med}(\tau) = \frac{1}{W-\tau}\gamma_{med}(\tau). \tag{5}$$

The trend is caused by the shrinking window for larger lags. A subrange of the periodicity vector may be selected as the final periodicity vector. The subrange may be taken as the range of bins corresponding to periods from 0.06 to 2.2 s, for example. Furthermore, the final periodicity vector may be normalized by removing the scalar mean and normalizing the scalar standard deviation to unity for each periodicity vector. The periodicity vector after normalization is denoted by s(τ). Note that instead of taking a median periodicity vector over time, the periodicity vectors in frames could be outputted and subjected to tempo estimation separately.

Tempo estimation is then performed based on the periodicity vector $s(\tau)$. The tempo estimation is done using k-Nearest Neighbour regression. Other tempo estimation methods could be used as well, such as methods based on finding the maximum periodicity value, possibly weighted by the prior distribution of various tempi.

Let's denote the unknown tempo of this periodicity vector with T. The tempo estimation may start with generation of resampled test vectors $s_r(\tau)$. r denotes the resampling ratio. The resampling operation may be used to stretch or shrink the test vectors, which has in some cases been found to improve results. Since tempo values are continuous, such resampling may increase the likelihood of a similarly shaped periodicity vector being found from the training data. A test vector resampled using the ratio r will correspond to a tempo of T/r. A suitable set of ratios may be, for example, 57 linearly spaced ratios between 0.87 and 1.15. The resampled test vectors correspond to a range of tempi from 104 to 138 BPM for a musical excerpt having a tempo of 120 BPM.

The tempo estimation comprises calculating the Euclidean distance between each training vector $t_m(\tau)$ and the resampled test vectors $S_r(\tau)$:

$$d(m, r) = \sqrt{\sum_{\tau} (t_m(\tau) - s_r(\tau))^2}\,. \tag{6}$$

In Equation (6), m=1, . . . , M is the index of the training vector. For each training instance m, the minimum distance $d(m)=\min_r d(m, r)$ may be stored. Also the resampling ratio that leads to the minimum distance $\hat{r}(m)=\mathrm{argmin}_r d(m, r)$ is stored. The tempo may then be estimated based on the k nearest neighbors that lead to the k lowest values of d(m). The reference or annotated tempo corresponding to the nearest neighbor i is denoted by $T_{ann}(i)$. An estimate of the test vector tempo is obtained as $\hat{T}(i)=T_{ann}(i)\hat{r}(i)$.

The tempo estimate can be obtained as the average or median of the nearest neighbor tempo estimates $\hat{T}(i)$, i=1, . . . , k. Furthermore, weighting may be used in the median calculation to give more weight to those training instances that are closest to the test vector. For example, weights $w_i$ can be calculated as $$w_i = \frac{\exp(-\vartheta d(i))}{\sum_{i=1}^{k} \exp(-\vartheta d(i))}, \tag{7}$$

where i=1, . . . , k. The parameter $\vartheta$ may be used to control the steepness of the weighting. For example, the value $\vartheta$=0.01 can be used. The tempo estimate $BPM_{est}$ can then be calculated as a weighted median of the tempo estimates $\hat{T}(i)$, i=1, . . . , k, using the weights $w_i$.

Figure 6:
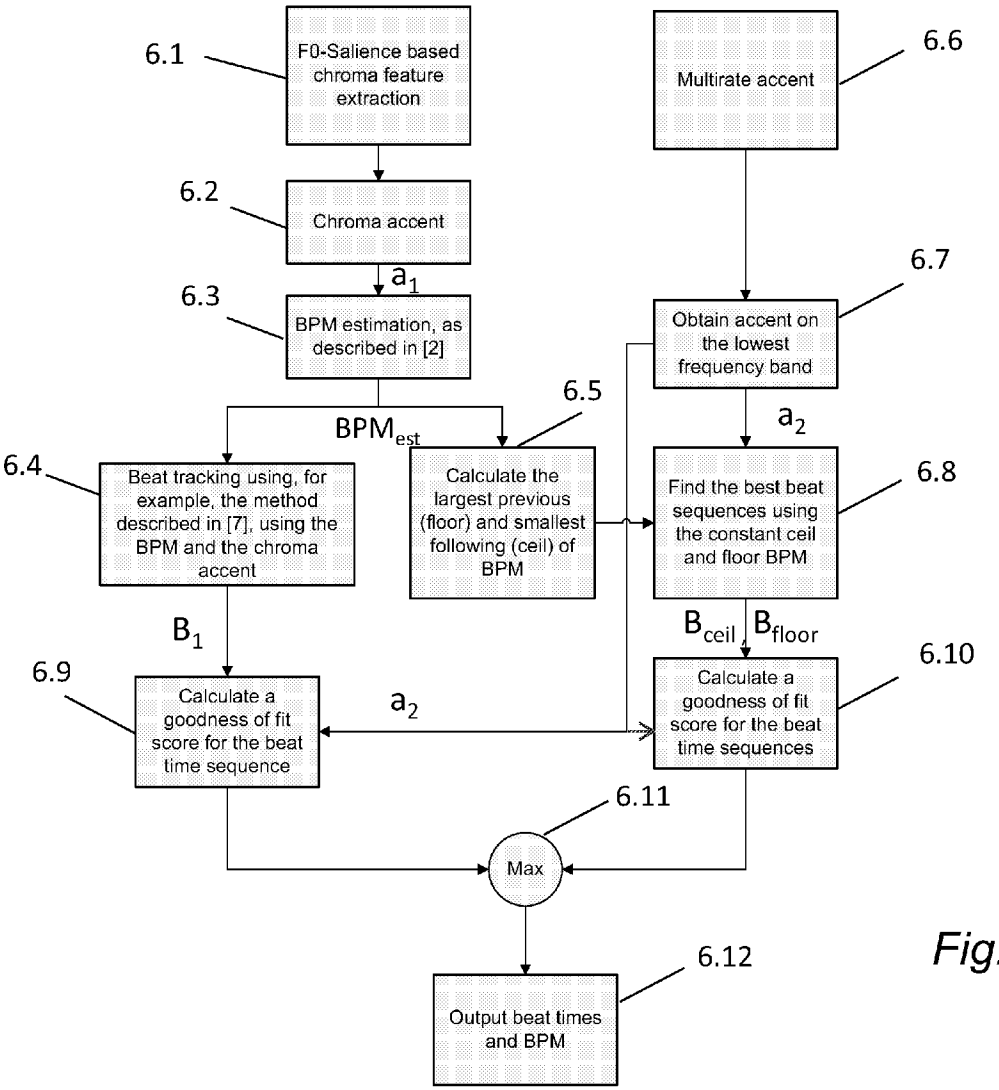
FIG. 6 is a block diagram showing processing stages performed by the analysis server shown in FIG. 1.

Referring still to FIG. 6, in step 6.4, beat tracking is performed based on the $BPM_{est}$ obtained in step 6.3 and the chroma accent signal ($a_1$) obtained in step 6.2. The result of this first beat tracking stage 6.4 is a first beat time sequence ($b_1$) indicative of beat time instants. For this purpose, we use a dynamic programming routine similar to the one described in [7]. This dynamic programming routine identifies the first sequence of beat times ($b_1$) which matches the peaks in the first chroma accent signal ($a_1$) allowing the beat period to vary between successive beats. There are alternative ways of obtaining the beat times based on a BPM estimate, for example, hidden Markov models, Kalman filters, or various heuristic approaches could be used. The benefit of the dynamic programming routine is that it effectively searches all possible beat sequences.

For example, the beat tracking stage 6.4 takes $BPM_{est}$ and attempts to find a sequence of beat times so that many beat times correspond to large values in the first accent signal ($a_1$). As suggested in [7], the accent signal is first smoothed with a Gaussian window. The half-width of the Gaussian window may be set to be equal to 1/32 of the beat period corresponding to $BPM_{est}$.

After the smoothing, the dynamic programming routine proceeds forward in time through the smoothed accent signal values ($a_1$). Let's denote the time index n. For each index n, it finds the best predecessor beat candidate. The best predecessor beat is found inside a window in the past by maximizing the product of a transition score and a cumulative score. That is, the algorithm calculates $\delta(n)=\max_l(ts(l)\cdot cs(n+l))$, where ts(l) is the transition score and cs(n+l) the cumulative score. The search window spans from l=−round(−2P), . . . , −round(P/2), where P is the period in samples corresponding to $BPM_{est}$. The transition score may be defined as $$ts(l) = \exp\left(-0.5\left(\theta * \log\left(\frac{l}{-P}\right)\right)^2\right), \tag{9}$$

where l=−round(−2P), . . . , −round(P/2) and the parameter $\theta$=8 controls how steeply the transition score decreases as the previous beat location deviates from the beat period P. The cumulative score is stored as $cs(n)=\alpha\delta(n)+(1-\alpha)a_1(n)$. The parameter $\alpha$ is used to keep a balance between past scores and a local match. The value $\alpha$=0.8. The algorithm also stores the index of the best predecessor beat as $b(n)=n+\hat{l}$, where $\hat{l}=\mathrm{argmax}_l(ts(n+l)+cs(n+l))$.

In the end of the musical excerpt, the best cumulative score within one beat period from the end is chosen, and then the entire beat sequence $B_1$ which caused the score is traced back using the stored predecessor beat indices. The best cumulative score can be chosen as the maximum value of the local maxima of the cumulative score values within one beat period from the end. If such a score is not found, then the best cumulative score is chosen as the latest local maxima exceeding a threshold. The threshold here is 0.5 times the median cumulative score value of the local maxima in the cumulative score.

It is noted that the beat sequence obtained in step 6.4 can be used to update the $BPM_{est}$. In some embodiments of the invention, the $BPM_{est}$ is updated based on the median beat period calculated based on the beat times obtained from the dynamic programming beat tracking step.

The value of $BPM_{est}$ generated in step 6.3 is a continuous real value between a minimum BPM and a maximum BPM, where the minimum BPM and maximum BPM correspond to the smallest and largest BPM value which may be output. In this stage, minimum and maximum values of BPM are limited by the smallest and largest BPM value present in the training data of the k-nearest neighbours-based tempo estimator.

$BPM_{est}$ Modification Using Ceiling and Floor Functions

Electronic music often uses an integer BPM setting. In appreciation of this understanding, in step 6.5 a ceiling and floor function is applied to $BPM_{est}$. As will be known, the ceiling and floor functions give the nearest integer up and down, or the smallest following and largest previous integer, respectively. The result of this stage 6.5 is therefore two sets of data, denoted as floor($BPM_{est}$) and ceil($BPM_{est}$). The values of floor($BPM_{est}$) and ceil($BPM_{est}$) are used as the BPM value in the second processing path, in which beat tracking is performed on a bass accent signal, or an accent signal dominated by low frequency components, to be described next.

Multi Rate Accent Calculation

A second accent signal ($a_2$) is generated in step 6.6 using the accent signal analysis method described in [3]. The second accent signal ($a_2$) is based on a computationally efficient multi rate filter bank decomposition of the signal. Compared to the $F_o$-salience based accent signal ($a_1$), the second accent signal ($a_2$) is generated in such a way that it relates more to the percussive and/or low frequency content in the inputted music signal and does not emphasize harmonic information. Specifically, in step 6.7, we select the accent signal from the lowest frequency band filter used in step 6.6, as described in [3] so that the second accent signal ($a_2$) emphasizes bass drum hits and other low frequency events. The typical upper limit of this sub-band is 187.5 Hz or 200 Hz may be given as a more general figure. This is performed as a result of the understanding that electronic dance music is often characterized by a stable beat produced by the bass drum.

Figure 10:
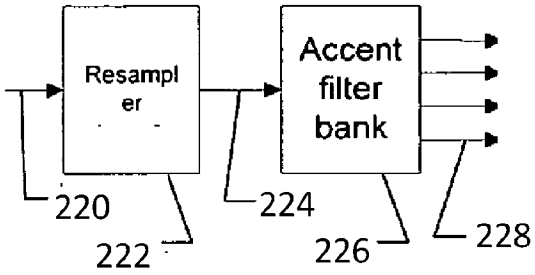
FIG. 10 depicts part of signal analyzer.
Figure 11:
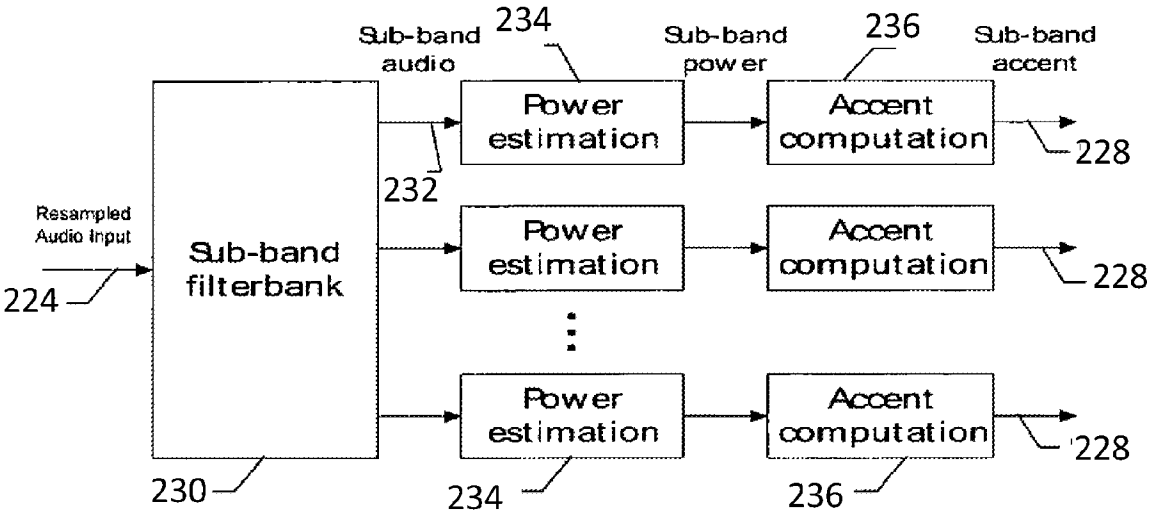
FIG. 11 depicts an embodiment of the accent filter bank.
Figure 12:
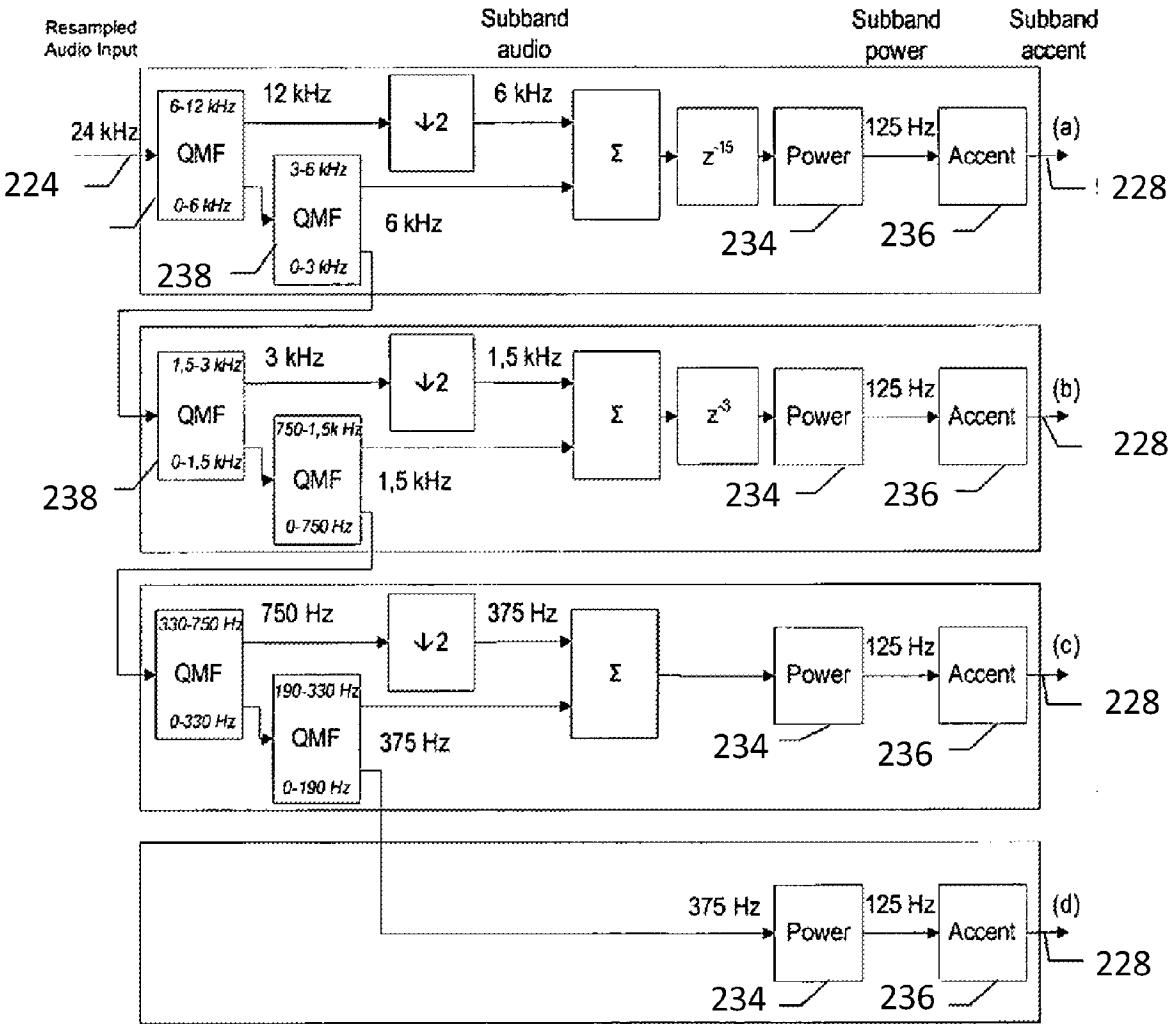
FIG. 12 depicts the embodiment of the accent filter bank in greater detail.

FIGS. 10 to 12 indicate part of the method described in [3], particularly the parts relevant to obtaining the second accent signal ($a_2$) using multi rate filter bank decomposition of the audio signal. Particular reference is also made to the related U.S. Pat. No. 7,612,275 which describes the use of this process. Referring to FIG. 10, part of a signal analyzer is shown, comprising a re-sampler 222 and an accent filter bank 226. The re-sampler 222 re-samples the audio signal 220 at a fixed sample rate. The fixed sample rate may be predetermined, for example, based on attributes of the accent filter bank 226. Because the audio signal 220 is re-sampled at the re-sampler 222, data having arbitrary sample rates may be fed into the analyzer and conversion to a sample rate suitable for use with the accent filter bank 226 can be accomplished, since the re-sampler 222 is capable of performing any necessary up-sampling or down-sampling in order to create a fixed rate signal suitable for use with the accent filter bank 226. An output of the re-sampler 222 may be considered as re-sampled audio input. So, before any audio analysis takes place, the audio signal 220 is converted to a chosen sample rate, for example, in about a 20-30 kHz range, by the re-sampler 222. One embodiment uses 24 kHz as an example realization. The chosen sample rate is desirable because analysis occurs on specific frequency regions. Re-sampling can be done with a relatively low-quality algorithm such as linear interpolation, because high fidelity is not required for successful analysis. Thus, in general, any standard re-sampling method can be successfully applied.

The accent filter bank 226 is in communication with the re-sampler 222 to receive the re-sampled audio input 224 from the re-sampler 22. The accent filter bank 226 implements signal processing in order to transform the re-sampled audio input 224 into a form that is suitable for subsequent analysis. The accent filter bank 226 processes the re-sampled audio input 224 to generate sub-band accent signals 228. The sub-band accent signals 228 each correspond to a specific frequency region of the re-sampled audio input 224. As such, the sub-band accent signals 228 represent an estimate of a perceived accentuation on each sub-band. Much of the original information of the audio signal 220 is lost in the accent filter bank 226 since the sub-band accent signals 228 are heavily down-sampled. It should be noted that although FIG. 10 shows four sub-band accent signals 228, any number of sub-band accent signals 228 are possible. In this application, however, we are only interested in obtaining the lowest sub-band accent signal.

An exemplary embodiment of the accent filter bank 226 is shown in greater detail in FIG. 11. In general, however, the accent filter bank 226 may be embodied as any means or device capable of down-sampling input data. As referred to herein, the term 3*o* down-sampling is defined as lowering a sample rate, together with further processing, of sampled data in order to perform a data reduction. As such, an exemplary embodiment employs the accent filter bank 226, which acts as a decimating sub-band filter bank and accent estimator, to perform such data reduction. An example of a suitable decimating sub-band filter bank may include quadrature mirror filters as described below.

As shown in FIG. 11 the re-sampled audio signal 224 is first divided into sub-band audio signals 232 by a sub-band filter bank 230, and then a power estimate signal indicative of sub-band power is calculated separately for each band at corresponding power estimation elements 234. Alternatively, a level estimate based on absolute signal sample values may be employed. A sub-band accent signal 228 may then be computed for each band by corresponding accent computation elements 236. Computational efficiency of beat tracking algorithms is, to a large extent, determined by front-end processing at the accent filter bank 226, because the audio signal sampling rate is relatively high such that even a modest number of operations per sample will result in a large number operations per second. Therefore, for this embodiment, the sub-band filter bank 230 is implemented such that the sub-band filter bank may internally down sample (or decimate) input audio signals. Additionally, the power estimation provides a power estimate averaged over a time window, and thereby outputs a signal down sampled once again.

As stated above, the number of audio sub-bands can vary. However, an exemplary embodiment having four defined signal bands has been shown in practice to include enough detail and provides good computational performance. In the current exemplary embodiment, assuming 24 kHz input sampling rate, the frequency bands may be, for example, 0-187.5 Hz, 187.5-750 Hz, 750-3000 Hz, and 3000-12000 Hz. Such a frequency band configuration can be implemented by successive filtering and down sampling phases, in which the sampling rate is decreased by four in each stage. For example, in FIG. 12, the stage producing sub-band accent signal (a) down-samples from 24 kHz to 6 kHz, the stage producing sub-band accent signal (b) down-samples from 6 kHz to 1.5 kHz, and the stage producing sub-band accent signal (c) down-samples from 1.5 kHz to 375 Hz. Alternatively, more radical down-sampling may also be performed. Because, in this embodiment, analysis results are not in any way converted back to audio, actual quality of the sub-band signals is not important. Therefore, signals can be further decimated without taking into account aliasing that may occur when down-sampling to a lower sampling rate than would otherwise be allowable in accordance with the Nyquist theorem, as long as the metrical properties of the audio are retained.

FIG. 12 illustrates an exemplary embodiment of the accent filter bank 226 in greater detail. The accent filter bank 226 divides the resampled audio signal 224 to seven frequency bands (12 kHz, 6 kHz, 3 kHz, 1.5 kHz, 750 Hz, 375 Hz and 125 Hz in this example) by means of quadrature mirror filtering via quadrature mirror filters (QMF) 238. Seven one-octave sub-band signals from the QMFs 102 are combined in four two-octave sub-band signals (a) to (d). In this exemplary embodiment, the two topmost combined sub-band signals (i.e., (a) and (b)) are delayed by 15 and 3 samples, respectively, (at z<–15> and z<–3>, respectively) to equalize signal group delays across sub-bands. The power estimation elements 234 and accent computation elements 236 generate the sub-band accent signal 228 for each sub-band.

For the present application, we are only interested in the lowest sub-band signal representing bass drum beats and/or other low frequency events in the signal. Before outputting, the lowest sub-band accent signal is optionally normalized by dividing the samples with the maximum sample value. Other ways of normalizing, such as mean removal and/or variance normalization could be applied as well. The normalized lowest-sub band accent signal is output as $a_2$.

Second Beat Tracking Stage

In step 6.8 of FIG. 6, second and third beat time sequences ($B_{ceil}$) ($B_{floor}$) are generated.

Inputs to this processing stage comprise the second accent signal ($a_2$) and the values of floor($BPM_{est}$) and ceil($BPM_{est}$) generated in step 6.5. The motivation for this is that, if the music is electronic dance music, it is quite likely that the sequence of beat times will match the peaks in ($a_2$) at either the floor($BPM_{est}$) or ceil($BPM_{est}$).

There are various ways to perform beat tracking using ($a_2$), floor($BPM_{est}$) and ceil($BPM_{est}$). In this case, the second beat tracking stage 6.8 is performed as follows.

Figure 7:
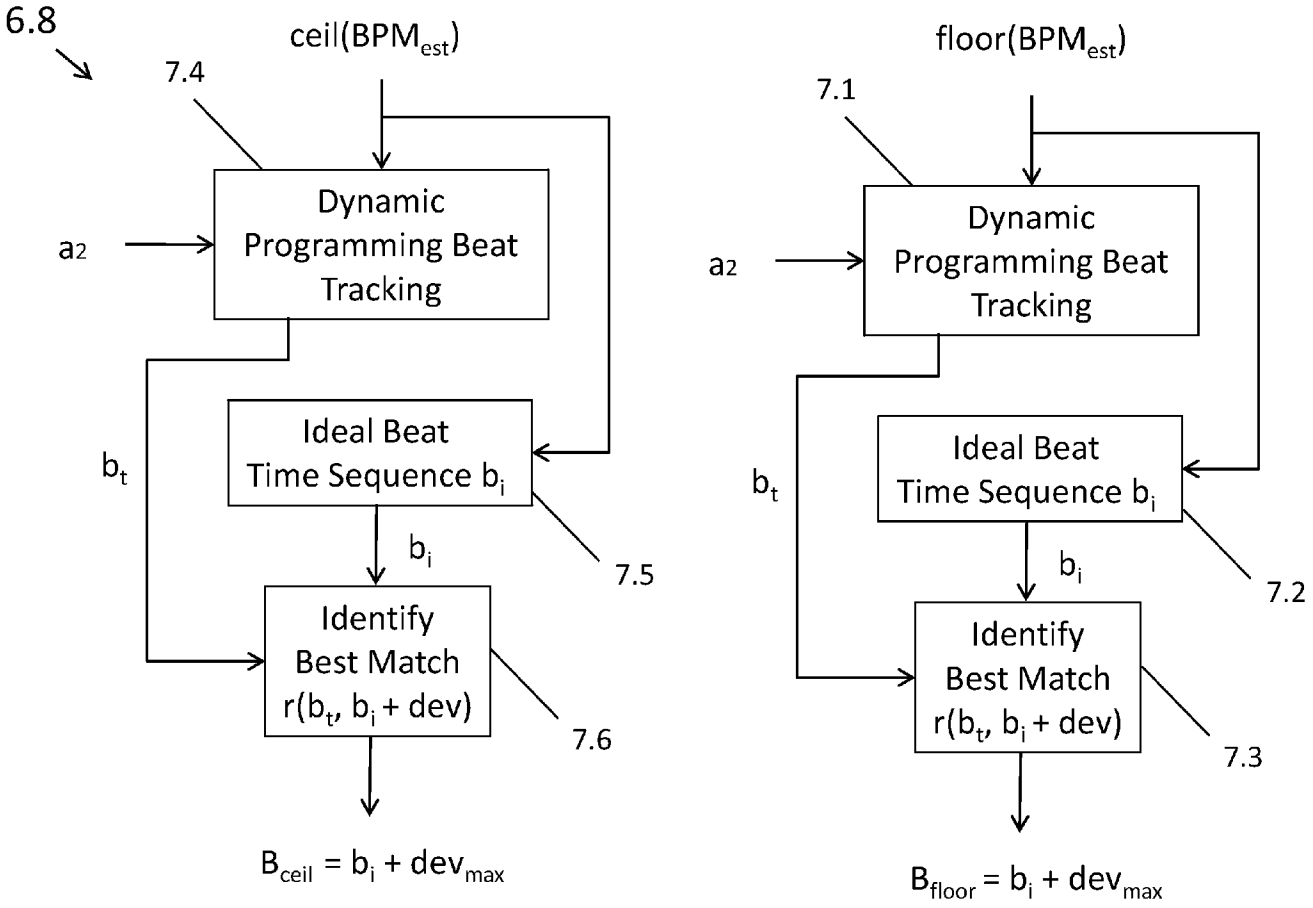
FIG. 7 is a block diagram showing processing stages performed by one sub-stage of the processing stages shown in FIG. 6.

Referring to FIG. 7, the dynamic programming beat tracking method described in [7] is performed using the second accent signal ($a_2$) separately applied using each of floor($BPM_{est}$) and ceil($BPM_{est}$). This provides two processing paths shown in FIG. 7, with the dynamic programming beat tracking steps being indicated by reference numerals 7.1 and 7.4.

The following paragraph describes the process for just one path, namely that applied to floor($BPM_{est}$) but it will be appreciated that the same process is performed in the other path applied to ceil($BPM_{est}$). As before, the reference numerals relating to the two processing paths in no way indicate order of processing; it is possible that both paths can operate in parallel.

The dynamic programming beat tracking method of step 7.1 gives an initial beat time sequence $b_t$. Next, in step 7.2 an ideal beat time sequence $b_i$ is calculated as:

$$b_i=0,1/(\text{floor}(BPM_{est})/60),2/(\text{floor}(BPM_{est})/60),etc.$$

Next, in step 7.3 a best match is found between the initial beat time sequence $b_t$ and the ideal beat time sequence $b_i$ when $b_i$ is offset by a small amount. For finding the match, we use the criterion proposed in [1] for measuring the similarity of two beat time sequences. We evaluate the score R($b_t$, $b_i$+dev) where R is the criterion for tempo tracking accuracy proposed in [1], and dev is a deviation ranging from 0 to 1.1/(floor($BPM_{est}$)/60) with steps of 0.1/(floor($BPM_{est}$)/60). Note that the step is a parameter and can be varied. In Matlab language, the score R can be calculated as

```
function R=beatscore_cemgil(bt,at)

sigma_e=0.04; % expected onset spread
% match nearest beats
id=nearest(at(:)',bt(:));
% compute distances
d=at-bt(id);
% compute tracking index
s=exp(-d.^2/(2*sigma_e^2));

R=2*sum(s)/(length(bt)+length(at));
```

The input 'bt' into the routine is $b_t$, and the input 'at' at each iteration is $b_i$+dev. The function 'nearest' finds the nearest values in two vectors and returns the indices of values nearest to 'at' in 'bt'. In Matlab language, the function can be presented as

```
function n=nearest(x,y)
% x row vector
% y column vector:
% indices of values nearest to x's in y
x=ones(size(y,1),1)*x;

[junk,n]=min(abs(x-y));
```

The output is the beat time sequence $b_i$+$dev_{max}$, where $dev_{max}$ is the deviation which leads to the largest score R. It should be noted that scores other than R could be used here as well. It is desirable that the score measures the similarity of the two beat sequences.

As indicated above, the process is performed also for ceil ($BPM_{est}$) in steps 7.4, 7.5 and 7.6 with values of floor($BPM_{est}$) being changed accordingly from the above paragraph.

The output from steps 7.3 and 7.6 are the two beat time sequences: $B_{ceil}$ which is based on ceil($BPM_{est}$) and $B_{floor}$ based on floor($BPM_{est}$). Note that these beat sequences have a constant beat interval. That is, the period of two adjacent beats is constant throughout the beat time sequences.

Selection of Beat Time Sequence

Referring back to FIG. 6, as a result of the first and second beat tracking stages 6.4, 6.8 we have three beat time sequences:

- $b_1$ based on the chroma accent signal and the real BPM value $BPM_{est}$;
- $b_{ceil}$ based on ceil($BPM_{est}$); and
- $b_{floor}$ based on floor($BPM_{est}$).

The remaining processing stages 6.9, 6.10, 6.11 determine which of these best explains the accent signals obtained. For this purpose, we could use either or both of the accent signals $a_1$ or $a_2$. More accurate and robust results have been observed using just $a_2$, representing the lowest band of the multi rate accent signal.

Figure 8:
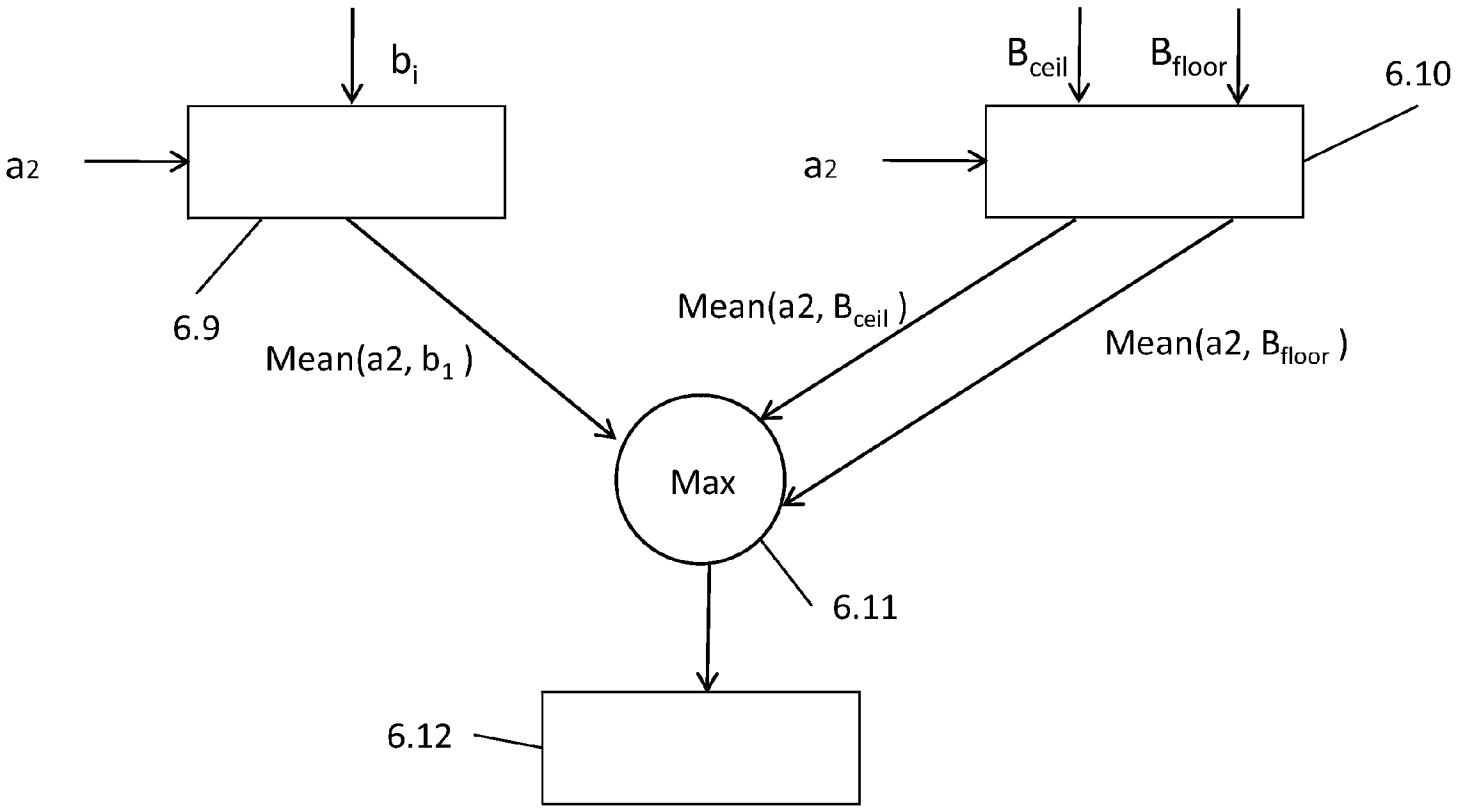
FIG. 8 is a block diagram showing in greater detail three processing stages performed in the processing stages shown in FIG. 6.

As indicated in FIG. 8, a scoring system is employed, as follows: first, we separately calculate the mean of accent signal $a_2$ at times corresponding to the beat times in each of $b_1$, $b_{ceil}$, and $b_{floor}$. In step 6.11, whichever beat time sequence gives the largest mean value of the accent signal $a_2$ is considered the best match and is selected as the output beat time sequence in step 6.12. Instead of the mean or average, other measures such as geometric mean, harmonic mean, median, maximum, or sum could be used.

As an implementation detail, a small constant deviation of maximum +/− ten-times the accent signal sample period is allowed in the beat indices when calculating the average accent signal value. That is, when finding the average score, the system iterates through a range of deviations, and at each iteration adds the current deviation value to the beat indices and calculates and stores an average value of the accent signal corresponding to the displaced beat indices. In the end, the maximum average value is found from the average values corresponding to the different deviation values, and outputted. This step is optional, but has been found to increase the robustness since with the help of the deviation it is possible to make the beat times to match with peaks in the accent signal more accurately. Furthermore, optionally, the individual beat indices in the deviated beat time sequence may be deviated as well. In this case, each beat index is deviated by maximum of −/+ one sample, and the accent signal value corresponding to each beat is taken as the maximum value within this range when calculating the average. This allows for accurate positions for the individual beats to be searched. This step has also been found to slightly increase the robustness of the method.

Intuitively, the final scoring step performs matching of each of the three obtained candidate beat time sequences $b_1$, $B_{ceil}$, and $B_{floor}$ to the accent signal $a_2$, and selects the one which gives a best match. A match is good if high values in the accent signal coincide with the beat times, leading into a high average accent signal value at the beat times. If one of the beat sequences which is based on the integer BPMs, i.e. $B_{ceil}$, and $B_{floor}$, explains the accent signal $a_2$ well, that is, results in a high average accent signal value at beats, it will be selected over the baseline beat time sequence $b_1$. Experimental data has shown that this is often the case when the inputted music signal corresponds to electronic dance music (or other music with a strong beat indicated by the bass drum and having an integer valued tempo), and the method significantly improves performance on this style of music. When $B_{ceil}$ and $B_{floor}$ do not give a high enough average value, then the beat sequence $b_1$ is used. This has been observed to be the case for most music types other than electronic music.

Instead of using the ceil($BPM_{est}$) and floor($BPM_{est}$), the method could operate also with a single integer valued BPM estimate. That is, the method calculates, for example, one of round($BPM_{est}$), ceil($BPM_{est}$) and floor($BPM_{est}$), and performs the beat tracking using that using the low-frequency accent signal $a_2$. In some cases, conversion of the BPM value to an integer might be omitted completely, and beat tracking performed using $BPM_{est}$ on $a_2$.

In cases where the tempo estimation step produces a sequence of BPM values over different temporal locations of the signal, the tempo value used for the beat tracking on the accent signal $a_2$ could be obtained, for example, by averaging or taking the median of the BPM values. That is, in this case the method could perform the beat tracking on the accent signal $a_1$ which is based on the chroma accent features, using the framewise tempo estimates from the tempo estimator. The beat tracking applied on $a_2$ could assume constant tempo, and operate using a global, averaged or median BPM estimate, possibly rounded to an integer.

In summary, the audio analysis process performed by the controller 202 under software control involves the steps of:

- obtaining a tempo (BPM) estimate and a first beat time sequence using a combination of the methods described in [2] and [7];
- obtaining an accent signal emphasizing low-frequency band accents using the method described in [3];
- calculating the integer ceil and floor of the tempo estimate;
- calculating a second and third beat time sequence using the accent signal and the integer ceil and floor of the tempo estimate;
- calculating a 'goodness' score for the first, second, and third beat time sequence using the accent signal; and
- outputting the beat time sequence which corresponds to the best goodness score.

The steps take advantage of the understanding that studio produced electronic music, and sometimes also live music (especially in clubs and/or other electronic music concerts or performances), uses a constant tempo which is set into sequencers, or is obtained through the use of metronomes. Moreover, often the tempo is an integer value. Experimental results have shown that the beat tracking accuracy on electronic music was improved from about 60% correct to over 90% correct using the above-described system and method. In particular, the beat tracking method based on the tempo estimation presented in [2] and beat tracking step presented in [7] applied on the chroma accent features sometimes tends to make beat phase errors, which means that the beats may be positioned between the beats rather than on beat. Such errors may be due to, for example, the music exhibiting large amounts of syncopation, that is having musical events, stresses, or accents off-beat instead of on-beat. The above described system and method was particularly helpful in removing beat phase errors in electronic dance music.

Although the main embodiment employs tempo estimation, period or frequency estimation could be used in a more generic sense, i.e. estimation of a period or frequency in the signal which corresponds to some metrical level, such as the beat. Period estimation of the beat period, is referred as tempo estimation, but other metrical levels can be used. The tempo is related to the beat period as 1/<beat period>*60, that is, a period of 0.5 seconds corresponds to a tempo of 120 beats per minute. That is, the tempo is a representation for the frequency of the pulse corresponding to the tempo. Alternatively, the system could of course use another representation of frequency, such as Hz, with 2 Hz corresponding to 120 BPM.

It will be appreciated that the above described embodiments are purely illustrative and are not limiting on the scope of the invention. Other variations and modifications will be apparent to persons skilled in the art upon reading the present application.

Moreover, the disclosure of the present application should be understood to include any novel features or any novel combination of features either explicitly or implicitly disclosed herein or any generalization thereof and during the prosecution of the present application or of any application derived therefrom, new claims may be formulated to cover any such features and/or combination of such features.

The invention claimed is:

1. Apparatus, the apparatus having at least one processor and at least one memory having computer-readable code stored thereon which when executed controls the at least one processor:

- to generate a first accent signal ($a_1$) representing musical accents in an audio signal by extracting chroma accent features based on fundamental frequency ($f_0$) salience analysis;
- to generate a second, different, accent signal ($a_2$) representing musical accents in the audio signal by using a predetermined sub-band of the audio signal's bandwidth;
- to estimate a first beat time sequence ($b_i$) from the first accent signal;
- to estimate a second beat time sequence ($b_2$) from the second accent signal; and
- to identify which one of the first and second beat time sequences ($b_i$) ($b_2$) corresponds most closely with peaks in one or both of the accent signal(s).

2. Apparatus according to claim 1, wherein the computer-readable code when executed controls the at least one processor to generate using the first accent signal ($a_1$) an estimated tempo ($BPM_{est}$) of the audio signal.

3. Apparatus according to claim 2, wherein the computer-readable code when executed controls the at least one processor to generate the first beat time sequence using the first accent signal ($a_1$) and the estimated tempo ($BPM_{est}$).

4. Apparatus according to claim 2, wherein the computer-readable code when executed controls the at least one processor to obtain an integer representation of the estimated tempo ($BPM_{est}$) and generate the second beat time sequence ($b_2$) using the second accent signal ($a_2$) and said integer representation.

5. Apparatus according to claim 4, wherein the computer-readable code when executed controls the at least one processor to calculate the integer representation of the estimated tempo ($BPM_{est}$) using either a rounded tempo estimate function (round($BPM_{est}$)), a ceiling tempo estimate function (ceil ($BPM_{est}$)) or a floor tempo estimate function (floor($BPM_{est}$)).

6. Apparatus according to claim 2, wherein the computer-readable code when executed controls the at least one processor to perform a ceiling and floor function on the estimated tempo ($BPM_{est}$) to generate respectively a ceiling tempo estimate (ceil($BPM_{est}$) and a floor tempo estimate (floor($BPM_{est}$)), to generate the second and a third beat time sequence ($b_2$) ($b_3$) using the second accent signal ($a_2$) and different ones of the ceiling and floor tempo estimates, and to identify which one of the first, second and third beat time sequences corresponds most closely with peaks in one or both of the accent signal(s).

7. Apparatus according to claim 6, wherein the computer-readable code when executed controls the at least one processor to generate, for each of the ceiling and floor tempo estimates, an initial beat time sequence ($b_t$) using said estimate, said initial beat time sequence then being compared with a reference beat time sequence ($b_i$) for generating the second and third beat time sequences using a predetermined similarity algorithm.

8. Apparatus according to claim 7, wherein the computer-readable code when executed controls the at least one processor to compare the initial beat time sequence ($b_t$) and the reference beat time sequence ($b_i$) over a range of offset positions to identify a best match within the range, the generated second/third beat time sequence comprising the offset version of the reference beat time sequence ($b_i$) which resulted in the best match.

9. Apparatus according to claim 7, wherein the reference beat time sequence (b) has a constant beat interval.

10. Apparatus according to claim 9 wherein the computer-readable code when executed controls the at least one processor to generate the reference beat time sequence ($b_i$) as t=0, 1/(X/60), 2/(X/60) . . . n/(X/60) where X is the integer representation of the estimated tempo and n is an integer.

11. Apparatus according to claim 8, wherein the computer-readable code when executed controls the at least one processor to use a range of offset positions in the algorithm of about 0 and 1.1/(X/60) where X is the integer representation of the estimated tempo.

12. Apparatus according to claim 8, wherein the computer-readable code when executed controls the at least one processor to use offset positions for comparison in the algorithm having steps of 0.1/($BPM_{est}$/60).

13. Apparatus according to claim 1, wherein the computer-readable code when executed controls the at least one processor to identify which one of the beat time sequences corresponds most closely with peaks in the second accent signal.

14. Apparatus according to claim 1, wherein the computer-readable code when executed controls the at least one processor to calculate, for each of the beat time sequences, the average or mean value of the or each accent signal occurring at or around beat times in the sequence, and to select the beat time sequence which results in the greatest mean value.

15. A method comprising:

generating a first accent signal ($a_1$) representing musical accents as a function of time in an audio signal by extracting chroma accent features based on fundamental frequency ($f_0$) salience analysis;

generating a second, different, accent signal ($a_2$) representing low frequency musical accents in the audio signal by using a predetermined sub-band of the audio signal's bandwidth;

estimating a first beat time sequence ($b_1$) from the first accent signal;

estimating a second beat time sequence ($b_2$) from the second accent signal; and identifying which one of the first and second beat time sequences ($b_1$) ($b_2$) corresponds most closely with peaks in one or both of the accent signal(s).

16. The method according to claim 15, further comprising:

generating using the first accent signal ($a_1$) an estimated tempo ($BPM_{est}$) of the audio signal.

17. The method according to claim 15, further comprising:

identifying which one of the beat time sequences corresponds most closely with peaks in the second accent signal.

18. A computer program product comprising at least one computer readable non-transitory medium having program code stored thereon, the program code, when executed by an apparatus, causing the apparatus at least to:

generate a first accent signal ($a_1$) representing musical accents as a function of time in an audio signal by extracting chroma accent features based on fundamental frequency ($f_0$) salience analysis;

generate a second, different, accent signal ($a_2$) representing low frequency musical accents in the audio signal by using a predetermined sub-band of the audio signal's bandwidth;

estimate a first beat time sequence ($b_1$) from the first accent signal;

estimate a second beat time sequence ($b_2$) from the second accent signal; and identify which one of the first and second beat time sequences ($b_1$) ($b_2$) corresponds most closely with peaks in one or both of the accent signal(s).

19. The computer program product according to claim 18, wherein the program code further causing the apparatus at least to:

generate using the first accent signal ($a_1$) an estimated tempo ($BPM_{est}$) of the audio signal.

20. The computer program product according to claim 18, wherein the program code further causing the apparatus at least to:

identifying which one of the beat time sequences corresponds most closely with peaks in the second accent signal.

* * * * *